US009248459B2

(12) United States Patent
Kah, Jr. et al.

(10) Patent No.: US 9,248,459 B2
(45) Date of Patent: Feb. 2, 2016

(54) ARC AND RANGE OF COVERAGE ADJUSTABLE STREAM ROTOR SPRINKLER

(76) Inventors: Carl L. C. Kah, Jr., North palm Beach, FL (US); Carl L. C. Kah, III, North Palm Beach, FL (US); Weiming Feng, West North Palm Beach, FL (US); Frederick A. Hall, Riviera Beach, FL (US)

( * ) Notice: Subject to any disclaimer, the term of this patent is extended or adjusted under 35 U.S.C. 154(b) by 1056 days.

(21) Appl. No.: 12/348,864

(22) Filed: Jan. 5, 2009

(65) Prior Publication Data

US 2009/0173803 A1 Jul. 9, 2009

Related U.S. Application Data

(60) Provisional application No. 61/018,847, filed on Jan. 3, 2008, provisional application No. 61/018,833, filed on Jan. 3, 2008.

(51) Int. Cl.
*B05B 3/02* (2006.01)
*B05B 3/04* (2006.01)

(52) U.S. Cl.
CPC ..... *B05B 3/0418* (2013.01); *B05B 3/045* (2013.01); *B05B 3/0427* (2013.01); *B05B 3/0454* (2013.01); *B05B 3/0486* (2013.01)

(58) Field of Classification Search
CPC ..... B05B 3/04; B05B 3/0409; B05B 3/0418; B05B 3/0422; B05B 3/0427; B05B 3/045; B05B 3/0454; B05B 3/0486
USPC ..... 239/222.11, 222.17, 252, 256
See application file for complete search history.

(56) References Cited

U.S. PATENT DOCUMENTS

| | | | | |
|---|---|---|---|---|
| 3,877,644 | A | 4/1975 | Cockman | |
| RE33,823 | E * | 2/1992 | Nelson et al. | 239/222.17 |
| 5,148,990 | A | 9/1992 | Kah, Jr. | |
| 5,630,549 | A | 5/1997 | Le | |
| 6,651,905 | B2 | 11/2003 | Sesser et al. | |
| 6,732,950 | B2 | 5/2004 | Ingham, Jr. et al. | |
| 7,232,081 | B2 | 6/2007 | Kah et al. | |
| 2006/0192029 | A1 | 8/2006 | Grizzle | |
| 2009/0140076 | A1 * | 6/2009 | Cordua | 239/457 |

OTHER PUBLICATIONS

International Search Report and Written Opinion dated May 5, 2009 corresponding to PCT Patent Application No. PCT/US 09/00040.

* cited by examiner

*Primary Examiner* — Christopher Kim
(74) *Attorney, Agent, or Firm* — Ostrolenk Faber LLP

(57) ABSTRACT

A sprinkler head nozzle assembly in accordance with an embodiment of the present invention includes a nozzle housing with an inlet for pressurized water and an outlet downstream of the inlet, a rotatable arc of coverage adjustment ring mounted on the housing such that rotation of the arc of coverage adjustment ring extends and reduces an arcuate exit opening, a range adjustment ring, or upstream flow area adjustment ring is also provided with an upstream flow area throttling element that increases or decreases the flow area as the range adjustment ring is rotated.

15 Claims, 30 Drawing Sheets

ARC AND RANGE OF COVERAGE ADJUSTABLE STREAM ROTOR SPRINKLER

CROSS-REFERENCE TO RELATED APPLICATIONS

The present application claims benefit of and priority to U.S. Provisional Patent Application Ser. No. 61/018,833 filed Jan. 3, 2008 entitled SPRINKLER HEAD NOZZLE ASSEMBLY WITH ARC COVERAGE SETTING RING AND RANGE OF COVERAGE SETTING RING and U.S. Provisional Patent Application Ser. No. 61/018,847 filed Jan. 3, 2008 entitled ARC AND RANGE OF COVERAGE ADJUSTABLE STREAM ROTOR SPRINKLER, the entire content of each of which is hereby incorporated by reference herein.

The present application is also related to U.S. Provisional Patent Application Ser. No. 60/912,836, filed Apr. 19, 2007, entitled ADJUSTABLE ARC FLOW RATE AND STREAM ANGLE VISCOUS DAMPED STREAM ROTOR, U.S. Provisional Patent Application Ser. No. 60/938,944, filed May 18, 2007, entitled LOW FLOW RATE FULLY ADJUSTABLE SPRINKLER NOZZLES and U.S. patent application Ser. No. 11/947,571, filed Nov. 29, 2007, entitled SPRINKLER HEAD NOZZLE ASSEMBLY WITH ADJUSTABLE ARC, FLOW RATE AND STREAM ANGLE, the entire content of each of which is hereby incorporated by reference herein.

BACKGROUND

1. Field of the Disclosure

The present disclosure relates to a sprinkler head nozzle assembly that includes a rotating deflector and provisions for adjustment of the arc of coverage, stream elevation angle, range and flow rate. The assembly is suitable for use in both gear driven and viscous damped self driven rotating deflectors.

2. Related Art

Prior art sprinkler nozzle assemblies have been provided that allow for arc of coverage adjustment such as U.S. Pat. No. 5,148,990 issued the inventor of the present application, however, this reference does not provide for easy adjustment of range from the outside of the assembly.

Other references describe partial arc of coverage adjustment and flow control with a center shaft and small screws. However, this type of flow control is relatively inconvenient. These references include U.S. Pat. Nos. 6,651,905, 6,736,332 4,986,474, 5,058,806 and 4,898,332.

However, the reference require the use of complex axially movable adjustment mechanisms which are difficult to manufacture and assemble. Further, none of these references disclose interlinking arc of coverage adjustment with proportional upstream throttling to maintain a constant range of coverage as the arc is changed.

Accordingly, it would be beneficial to provide a sprinkler nozzle assembly that avoids these problems.

SUMMARY

A sprinkler head nozzle assembly in accordance with an embodiment of the present application includes a nozzle housing with an inlet for pressurized water and an outlet downstream of the inlet, a rotatable arc of coverage adjustment ring mounted on the housing such that rotation of the arc of coverage adjustment ring increases or decreases an arcuate water outlet, or exit, opening, or orifice, to increase or decrease the arc of coverage of water around the sprinkler and a range adjustment ring mounted on the nozzle housing for adjusting an upstream flow area in the nozzle housing to reduce a pressure of water provided to the arcuate water outlet opening such that the discharge velocity, and thus, the range of coverage of the water and flow rate are changed in accordance with the arc of coverage.

A sprinkler head nozzle assembly in accordance with an embodiment of the present application includes a nozzle housing including an inlet for pressurize water and an outlet downstream of the inlet, a rotating arc adjustment ring mounted on the housing such that rotation of the arc adjustment ring extends and reduces an arcuate exit opening to set an arc of coverage of the sprinkler head nozzle assembly, a rotating range adjustment ring mounted on the housing upstream of the arc adjustment ring such that rotation of the range adjustment ring increased and decreases a downstream flow area to control flow of water to the arcuate exit opening and a rotating deflector, mounted on a central shaft extending through the arc adjustment ring, the range adjustment ring and the nozzle housing operable to deflect a flow of water extending through the flow area and the arcuate exit opening out of the nozzle assembly, wherein the range adjustment ring is operationally linked to the arc adjustment ring such that the flow area is adjusted with the arcuate exit opening to maintain substantially the same range of coverage of the water deflected out of the nozzle assembly as the arc of coverage is adjusted.

A sprinkler head assembly in accordance with another embodiment of the present application includes a nozzle housing including an inlet for pressurize water and an outlet downstream of the inlet, a rotating arc adjustment ring mounted on the housing such that rotation of the arc adjustment ring extends and reduces an arcuate exit opening to set an arc of coverage of the sprinkler head nozzle assembly, a rotating range adjustment ring mounted on the housing upstream of the arc adjustment ring such that rotation of the range adjustment ring increases and decreases a downstream flow area to control flow of water to the arcuate exit opening; and a rotating deflector, mounted on a central shaft extending through the arc adjustment ring, the range adjustment ring and the nozzle housing operable to deflect a flow of water extending through the flow area and the arcuate exit opening out of the nozzle assembly, wherein the arcuate exit opening is formed by interaction of a first axially stepped spiral surface of the arc adjustment ring and a second axially stepped spiral surface of the nozzle housing.

A sprinkler nozzle assembly according to another embodiment of the present application includes a nozzle housing including an inlet for pressurize water and an outlet downstream of the inlet, a self driven rotary deflector mounted for rotation on a center shaft that passes through the nozzle housing and a viscous dampening assembly wherein a clearance between a rotor connected to the center shaft and an inner surface of the assembly housing is adjustable to adjust a speed of rotation of the deflector.

The present application provides for nozzle configurations that use both arcuate slot members interacting with closure members and axially stepped interacting spirals that rotate relative to each other to provide a fully adjustable arcuate length outlet opening for discharging water onto a deflector, whether rotatable or stationary. That is, the nozzle assembly of the present disclosure is suitable for use in fixed spray nozzle type sprinklers as well as rotary deflector stream rotors.

The arc and range control elements of the present application are preferably mounted on the nozzle housing and are shown with rotary viscous damping provided by an upstream housing mounted assembly as well as with viscous damping provided in the self driven rotary deflector itself.

The range adjustment ring may be functionally coupled to the rotatable arc of coverage adjustment ring so that as the arc of coverage adjustment ring is rotated, the range adjustment ring rotates with it unless one of these rings is separately held and their relative rotational position is changed to establish a different flow rate and upstream restriction which is varied proportionally to the arcuate slot opening as the arc of coverage is set to maintain constant range of coverage as the arc of coverage changes.

Thus, for any arc of coverage, once the rotational relationship of these two rings is set to provide a desired range of coverage outwardly from the sprinkler, this range of coverage is maintained for whatever different arc of coverage is now set due to the upstream proportional throttling that occurs as the arc set ring is rotated which also rotates the frictionally coupled range adjustment ring.

Also disclosed herein is a simple non-axially moving partial arc of coverage arcuate slot opening valve configuration settable, for example, from 85°-185° of coverage by a circumferentially mounted ring on the sprinkler nozzle assembly body.

The components of this arcuate length flow settable valve are preferably snapped together during assembly to provide an adjustable arc of coverage range: i.e. of 85° to 185°, or full circle and a range of coverage: i.e. 8 to 25 ft., for example. This allows for a low cost sprinkler with arc and range of coverage control.

Other features and advantages of the present invention will become apparent from the following description of the invention which refers to the accompanying drawings.

DETAILED DESCRIPTION OF THE EMBODIMENTS

Figure 1:
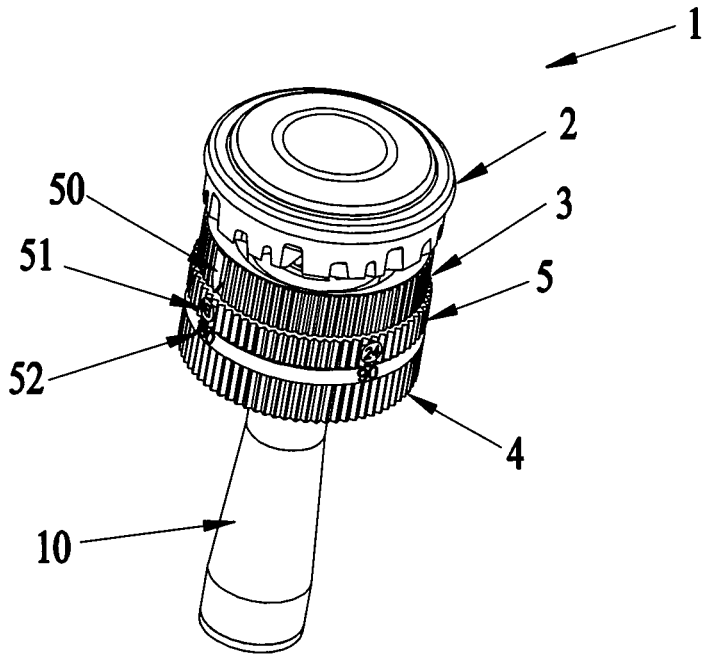
FIG. 1 shows a perspective view of a nozzle assembly with both an arc of coverage adjustment ring and a range of coverage adjustment ring on the outside of the nozzle housing assembly in accordance with an embodiment of the present application.
Figure 2:
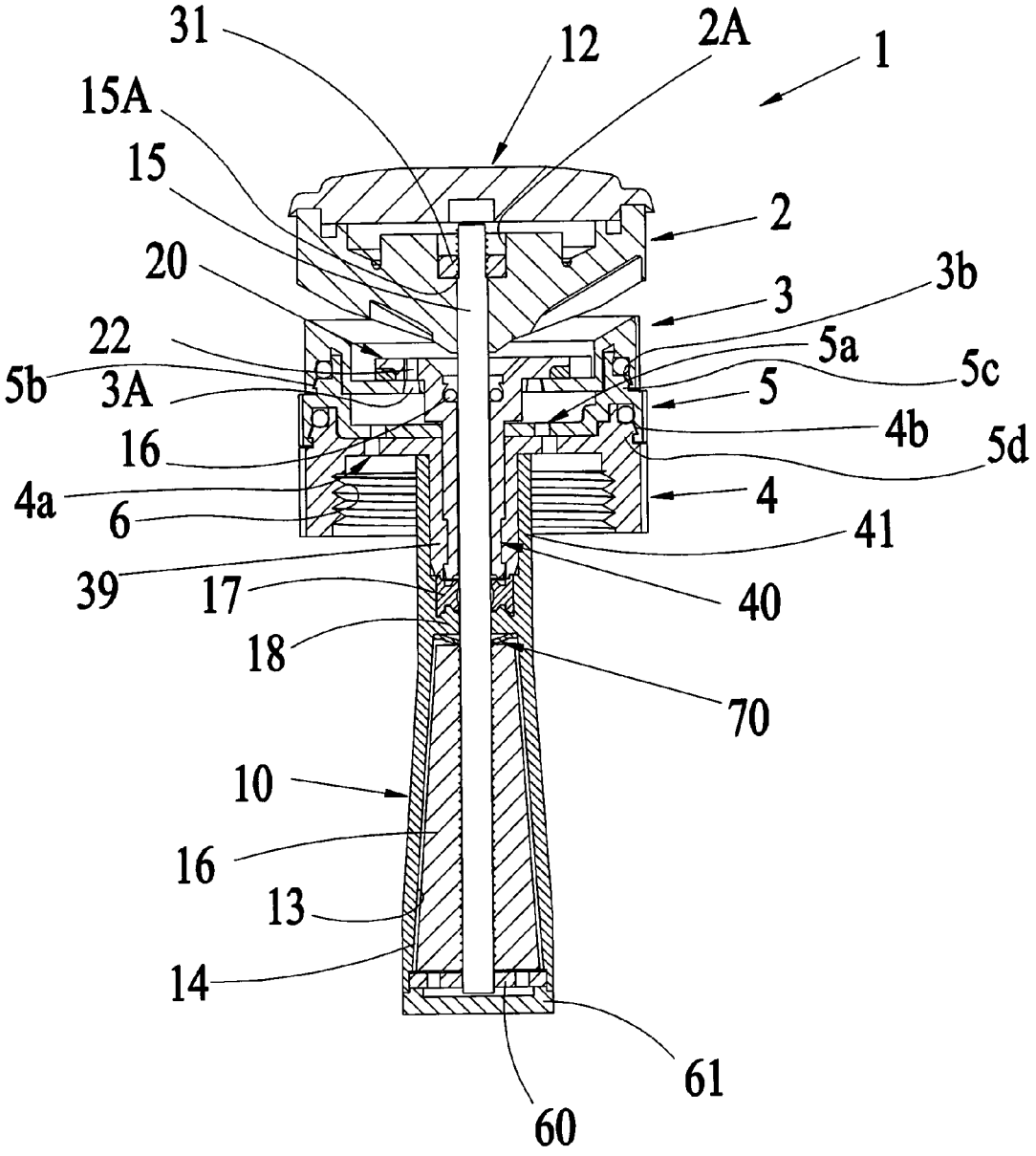
FIG. 2 shows a cross section of a nozzle assembly with both an arc of coverage adjustment ring and a range of coverage adjustment ring in accordance with an embodiment of the present application.
Figure 3:
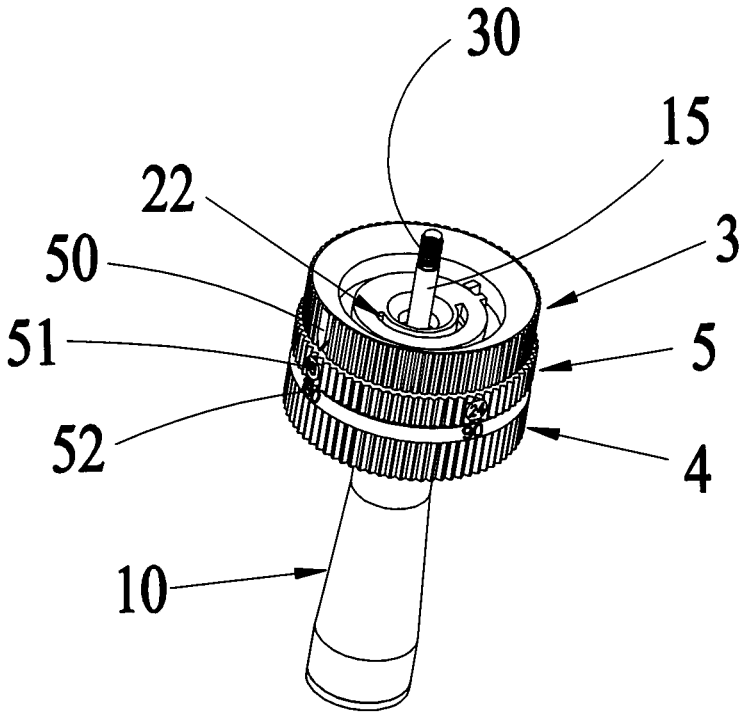
FIG. 3 shows a perspective view of the nozzle assembly of FIG. 2 with its self driven stream deflector removed from the top of the viscous damped rotatable support shaft.

A partially adjustable arc of coverage sprinkler head nozzle assembly 1, in accordance with an embodiment of the present application is shown in perspective view in FIG. 1 and in cross section in FIG. 2. The nozzle assembly 1 includes a nozzle housing 4 with an adjustable arcuate opening, or slot 22 formed in slot member 20, as can be seen in FIG. 3, for example. An arc adjustment ring 3 is held in place above a range adjustment ring 5 on the nozzle housing 4, preferably by a snap fit connection into the body 4 at 40, for example, with a particular length of the opening 3A as seen in FIG. 2 to set the arc of coverage via slot 22 of the assembly 1.

The arc adjustment ring 3 and the range adjustment ring 5 may also be snapped together around their outside circumference by the matching steps and notches (3*c*, 4*c*, 5*b* and 5*c*) provided on the circumferences of these rings, as shown in FIG. 2, for example.

The slot member 20 is rotationally fixed in the nozzle housing 4 such that slot 22 in slot member 20 is opened and closed by rotation of the arc adjustment ring 3, which moves the opening 3A into an open relationship with slot 22 as shown on the left hand side in FIG. 2, and closed position shown on right hand side. That is, the opening 3A is moved into and out of alignment with the slot 22 to adjust a length of the open area thereof to set the arc of coverage for the assembly 1.

The arc adjustment ring 3 is preferably frictionally coupled to the range adjustment ring 5 so that as the arc adjustment ring is rotationally set to uncover the desired arcuate length of slot 22, an upstream flow area is increased or decreased to provide upstream flow restriction, to adjust the range of coverage. That is, as the arc of coverage is increased by rotation of the arc adjustment ring 3, the upstream flow area is preferably increased to increase the flow of water to match the same range of coverage of water over the increased arc of coverage. Similarly, as the arc of coverage decreases, the upstream flow area is decreased so that the range of coverage of water remains the same for the smaller arc of coverage.

FIG. 3 shows a perspective view of the nozzle housing assembly 1 of FIG. 1, showing the slot member 20 with the slot 22 formed therein positioned above the arc adjustment ring 3 and the range adjustment ring 5. The rotating deflector 2 of FIG. 2 is preferably mounted on the shaft 15 via the threaded portion 30, thereof also illustrated in FIG. 3.

As shown in FIG. 3, the rotational relationship between rings 3 and 5 may be used to indicate the arc of coverage that is set and the range of coverage that is selected. The indicator 50 on the ring 3 indicates the specific arc of coverage that is set based on the indication 52 on the outer circumference of the nozzle housing 4. The indicator 50 also specifies the indicated range that is set based on the indication 51 on the outer circumference of the range adjustment ring 5. These values are preferably set based on a standard water pressure such as 30 psi being provided as a supply pressure.

More specifically, as shown at FIG. 2, the arc set ring 3 is preferably snapped over a step 5*b* on the upper pilot diameter 5*c* of the range adjustment ring 5 and is retained axially by engagement with notch 3*b* formed around the inner circumference of arc adjustment ring 3. The range adjustment ring 5 may be snapped over the step 4*b* around the pilot diameter 4*c* of the nozzle housing 4 and retained axially by engagement with notch 5*d*.

In this manner, the rings 3 and 5 are retained axially around their outer circumference, but are free to be rotated without restriction unless stops are desired. In a preferred embodiment, the range adjustment ring 5 may also be rotated to a fully shut off position if desired. That is, the range adjustment ring may be rotated such that the flow area is reduced to essentially 0, if desired. The slot member 20 is preferably snapped into the nozzle housing 4 at 40 as is illustrated in FIG. 2.

The relative position of the range adjustment ring 5 to the nozzle housing 4 is used to adjust the flow of water through the nozzle assembly 1. Specifically, a radially stepped opening 5*a* is formed through the range adjustment ring 5 and interacts with a matching radially stepped opening 4*a* in the nozzle housing 4. The opening 5*a* has a uniformly increasing radial distance for each degree of rotation such that rotation of the ring 5 increases or decreases the flow area proportionally to maintain a desired flow to arc of coverage ratio. The flow area may be uniformly opened or closed as shown in FIG. 4B.

Figure 4A:
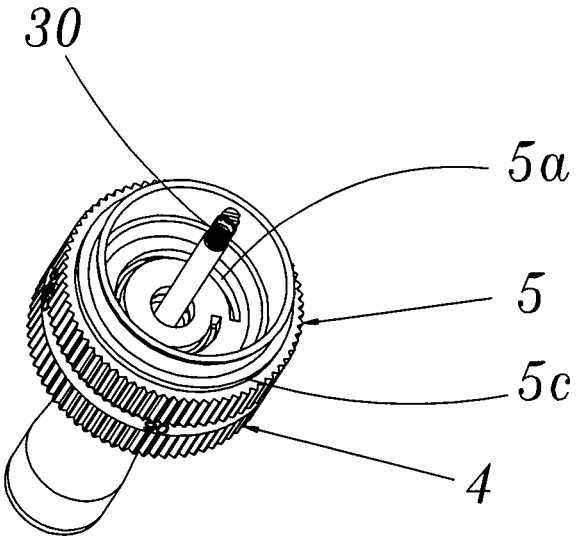
FIG. 4 shows a top perspective view with the rotating deflector and arc set ring removed looking down into the range control ring showing the flow control radial stepped spiral.
FIG. 4B is a view looking straight through the radially stepped range throttling valve opening.
FIG. 4C is a perspective view looking down into the nozzle housing of the FIG. 6 with the range control ring removed showing the fixed, radially stepped upstream throttling spiral.
Figure 4B:
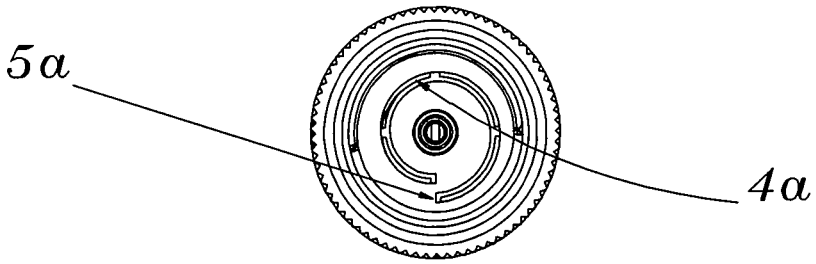
Figure 4C:
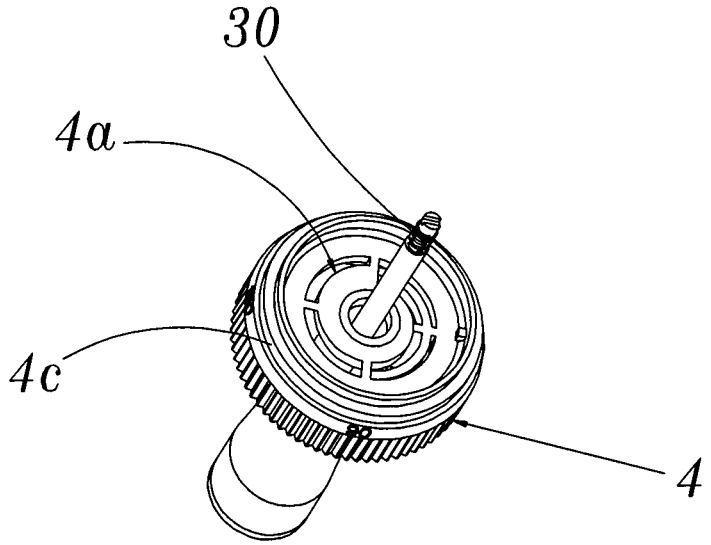

The radially spaced opening 5*a* formed in the range adjustment ring 5 is illustrated in FIG. 4A. The correspondence of the opening 5*a* in the range adjustment ring and the opening 4*a* formed in the nozzle housing 4 is illustrated in FIG. 4B. This opening 4*a* is shown in the nozzle housing 4 in FIG. 4C.

A viscous damping assembly 10 is preferably provided in a lower portion of the assembly 1 to control the speed of rotation of a rotating deflector 2. As noted above, the deflector 2 is mounted on the rotating shaft 15. A rotor assembly 16 is connected to the shaft 15 and viscous damping is provided based on the spacing between the rotor 16 and an inner surface 13 of the assembly 10. The smaller the space, the more viscous damping is provided.

A hex shaped nut is preferably rotationally tied to the inside opening 2A of the deflector 2. As the deflector 2 rotates, the shaft 15 which is coupled to the nut 31 also rotates. The shaft extends down through the slot member 20 and fit into lower viscous damping assembly 10 of nozzle housing 4 at 40.

Specifically, a tapper rotor 16 that preferably has a thin light spring rating, i.e. ½ pound per 1/16 of an inch of compression wave washer 70 that changes to allow the running clearance between the rotor 16 and the inside wall 13 of the housing to be reduced as the upward pressure increases on the deflector 2 and pulls up the shaft 15. This provides rotor speed compensation for changes of flow rate and slow rate changes for range changes discharging onto the rotating self driven deflector 2.

When the assembly 1 is first provided with water, viscous damping is at a minimum. Viscous drag is essentially directly proportional to the clearance between the stationary surface 13 and the rotor 16. Since the walls of the damping chamber are tapered, the clearance between the wall and the rotor is increased as the washer moves the rotor downward for less viscous rotational resistance. When the pressure directed against the deflector 2 increases, the load on the deflector upward and this axial load are transferred to the viscous damping rotor 16 it compresses the washer and causes the clearance to be reduced and the resistance to increase. As a result, it is easier to limit speed despite the increased pressure of the water and there is less viscous rotational resistance when the sprinkler is first starting to the assembly to overcome any static friction.

The assembly 1 provides only partial arc of coverage adjustment in that the arc of coverage is only adjustable based on the length of the slot 22 and its closed off area which hides the closure part of the arc set ring 3 as at 3A.

Figure 23:
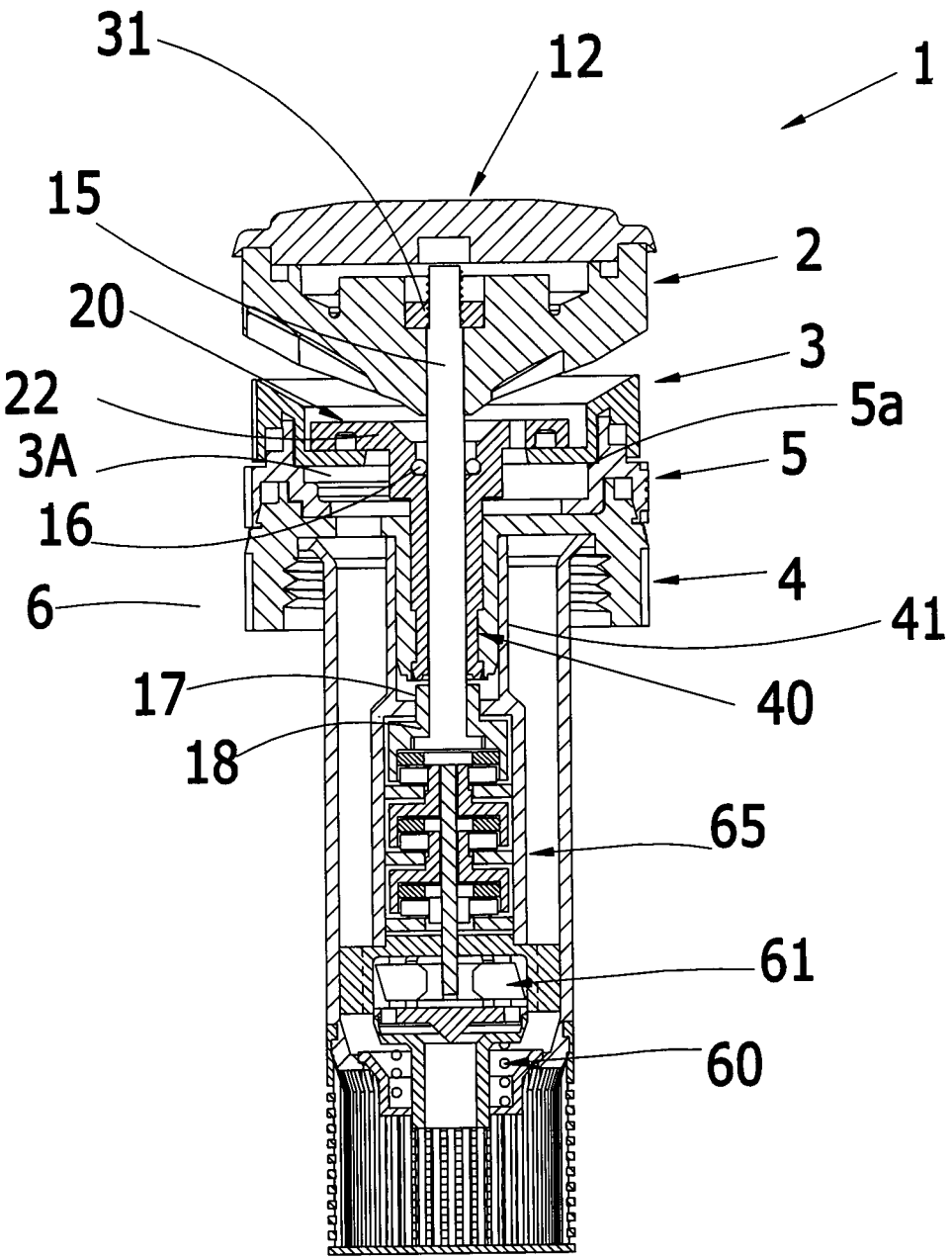
FIG. 23 is a cross section of the nozzle assembly of FIG. 2 with the viscous damping rotor assembly removed and replaces by a turbine driven gear assembly with spring loaded pressure bypass valve for speed control.

An alternative embodiment of an adjustable nozzle assembly 1' is illustrated in FIG. 23. The assembly 1' is similar to that illustrated in FIGS. 1-4 except that the viscous dampening assembly 10 has been replaced by a water turbine assembly 65. The turbine is shown conceptually at 61 with its spring loaded bypass valve shown at 60 to maintain a substantially constant pressure drop across the driving turbine to provide constant speed driving of the deflector 2 over a large range of flow rates. In all other aspects, the assembly $1^1$ operates in substantially the same manner as the assembly 1 illustrated in and described with reference to FIGS. 1-4 above. In this embodiment the turbine assembly 65 is used to rotate the deflector 2 at the desired speed.

Figure 24:
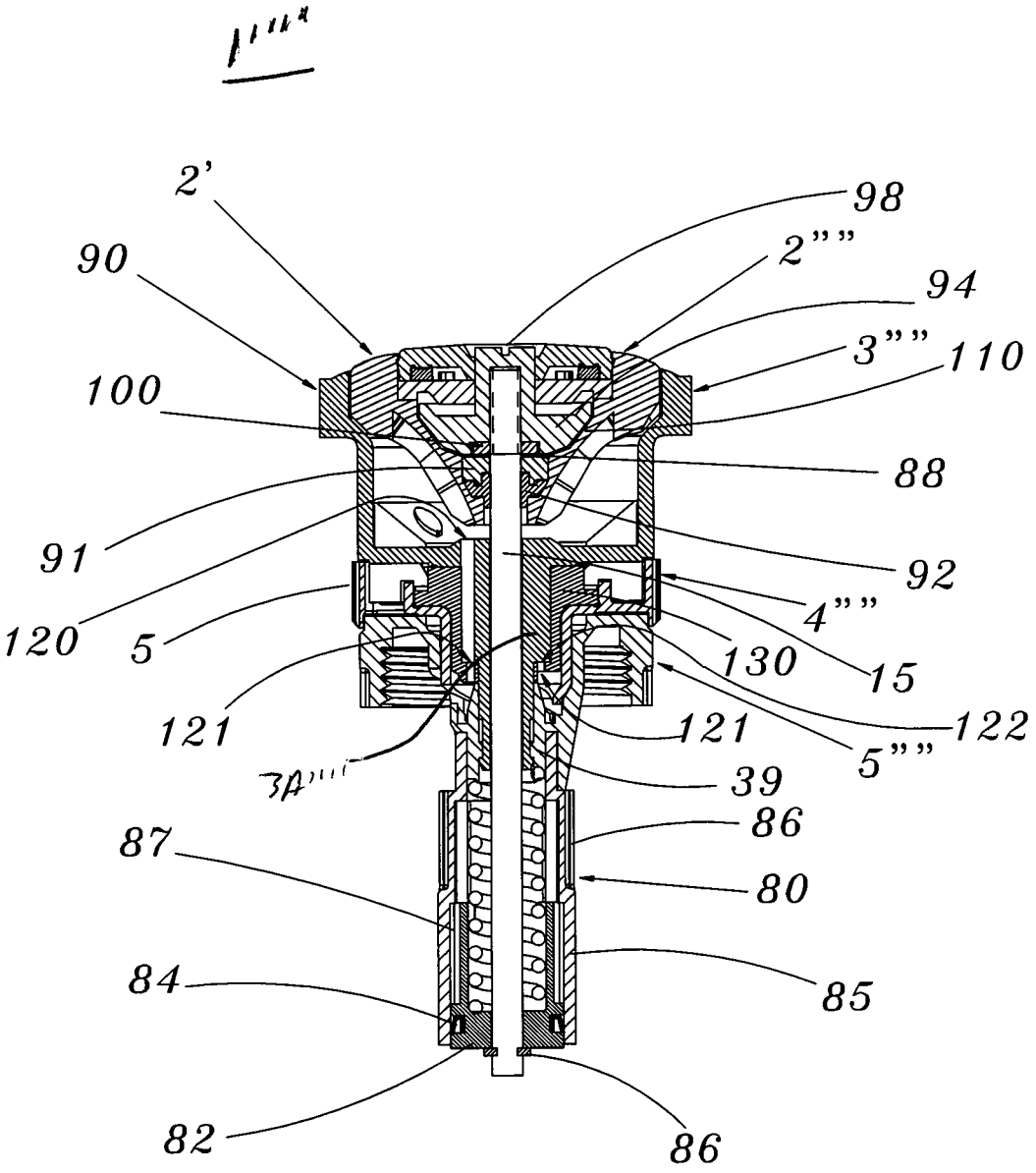
FIG. 24 is a cross section of the nozzle assembly in FIG. 20 with the viscous damping rotor assembly removes from its bottom location and incorporated into the self driven rotary distributing deflector and a spring retraction and pressure actuated rotating deflector shaft extension assembly provided in the lower location.
Figure 25:
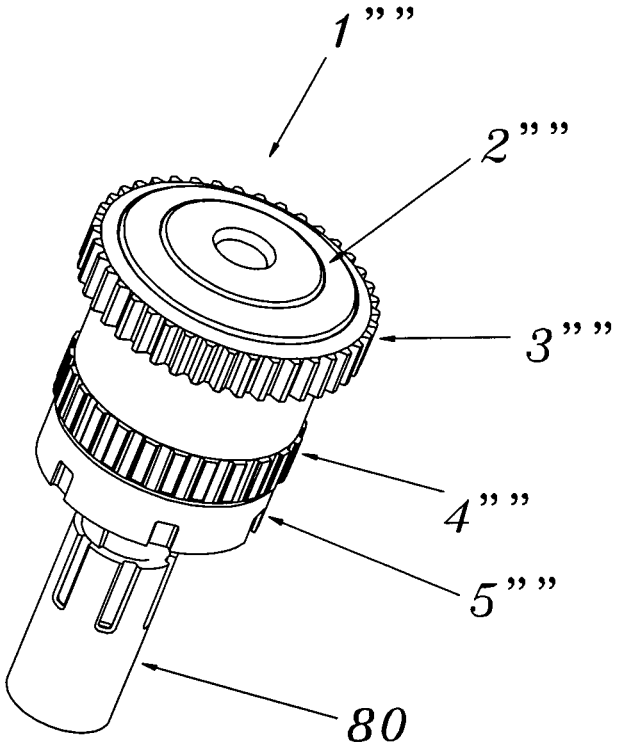
FIG. 25 is a perspective view of the nozzle assembly of FIG. 24.

In the alternative assembly 1"41 of FIG. 24, the damping configuration of FIGS. 1 and 2 has been replaced by a center mounted shaft extension and retraction actuator 80. The actuator 80 is used to aid the deflector 2 upward during operation regardless of supply water pressure and to retract the deflector 2 as shown in FIG. 25 when not in operation. The arc adjustment and range adjustment rings are the same with the deflector 2 retracted into the housing and the arc adjustment ring with its sides lengthened to enclose the stream slot of the reduced diameter deflector when not in operation. Actuation piston 82 has a lip seal 84 sealing the inside surface cylindrical area 85 with ribs 87 on the upper side of the piston that move in slot 86 in the upper spring housing of the actuator 80 to prevent rotation of the center shaft 15. In this manner, the shaft 15 is axially movable but does not rotate. The deflector 2 is mounted to rotate on the shaft 15.

In the deflector 2"", as shown in FIG. 24, a lower seal 92 and a thin teflon washer 88 for lower deflection bearing insert 91 are provided to load against tension nut 100 which is screwed down on the upper threaded area of shaft 15.

An adjustable viscous damping stator 94 is screwed down onto the thread on shaft 15 above the rotating deflector retention nut 100. Turning the adjustable stator 94 via slot 98 about its threads on the shaft 15 changes the viscous damping clearance 110 during operation. This allows for adjusting rotational speed of the self driven deflector 2"" by tangential components of the discharge stream.

Figure 26:
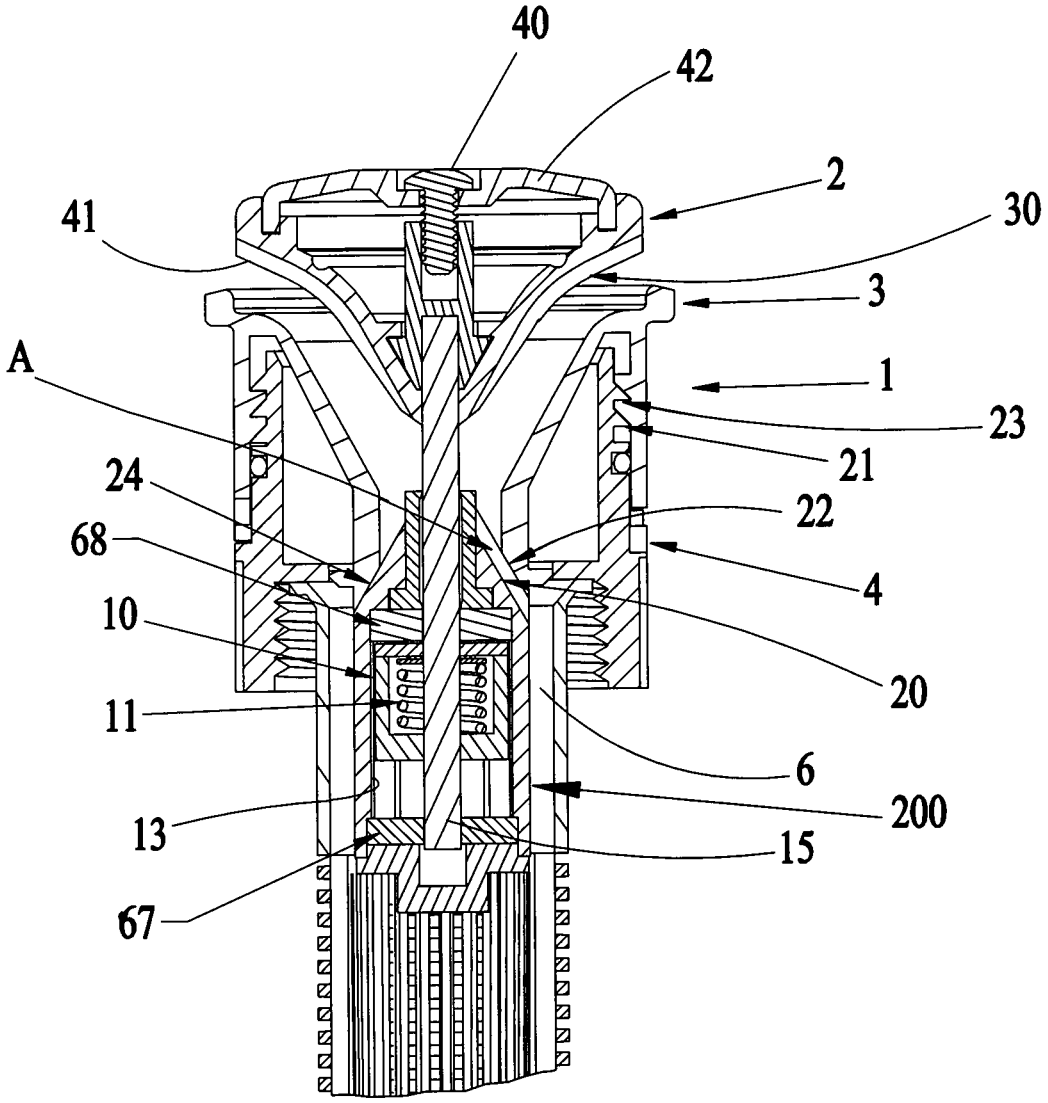
FIG. 26 is a cross section of a nozzle assembly in U.S. patent application Ser. No 11/947,541 illustrating the rotating deflector shaft connected to a bottom mounted combination viscous damping and rotating shaft extension and retraction mechanism.

FIG. 26 illustrates that the lower combination of viscous damping and nozzle extension previously discussed.

Figure 5:
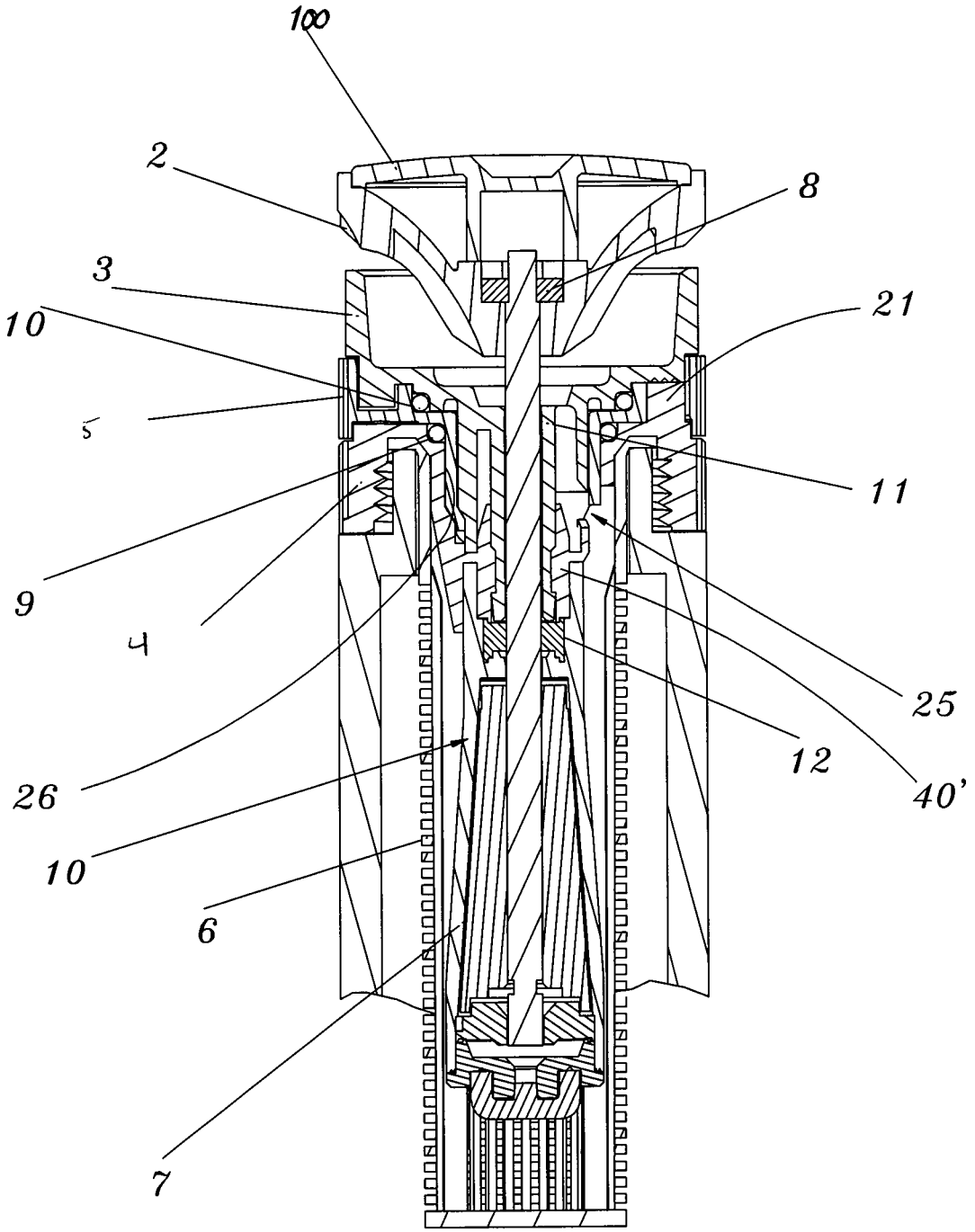
FIG. 5 shows a cross section of an alternate configuration of the adjustable slot length with ring arc set and range adjustment and an upstream rotary throttling valve.

FIG. 5 shows a cross section of a fixed arc of coverage sprinkler nozzle head assembly 100 that utilizes a rotary valve type range flow control in accordance with an embodiment of the present application. That is, in the assembly 100 of FIG. 5, the arc of coverage is preferably preset, however, flow control is adjustable by rotation of the range adjustment ring 5. This range adjustment ring 5 is illustrated in more detail in FIG. 7, for example.

Figure 6:
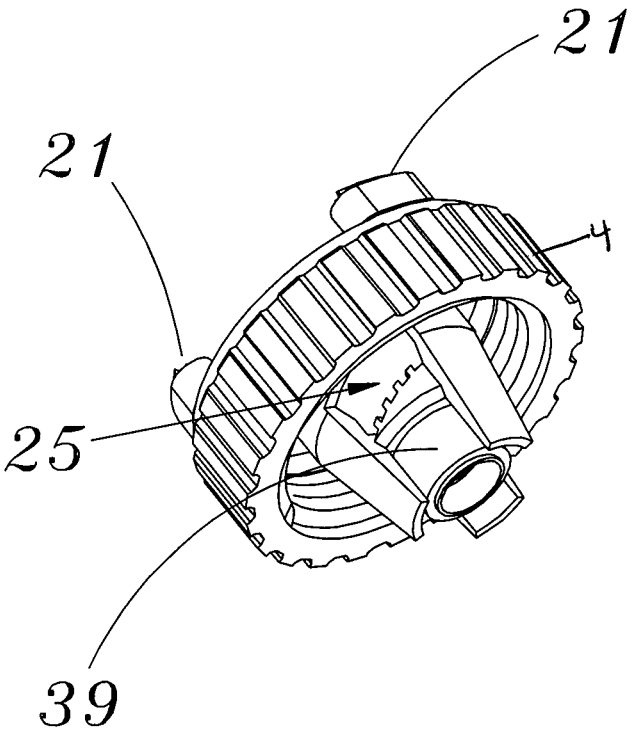
FIG. 6 is a perspective view of the bottom of the nozzle housing of FIG. 5.
Figure 7:
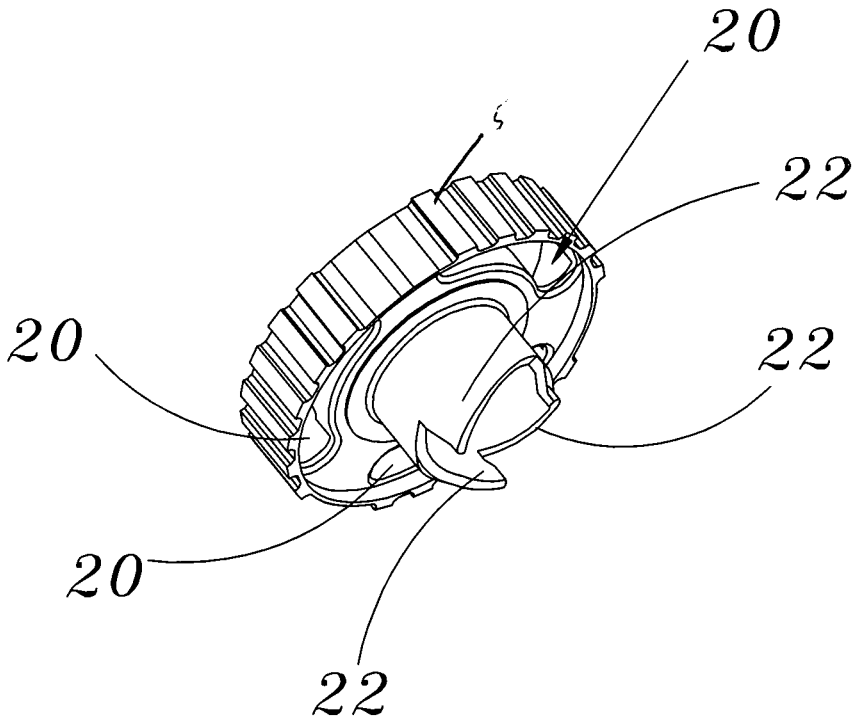
FIG. 7 is a perspective view from the bottom of the range of coverage setting ring FIG. 8 s a perspective view of the range of coverage setting ring in place in the nozzle housing showing the flow area fully open.
Figure 8:
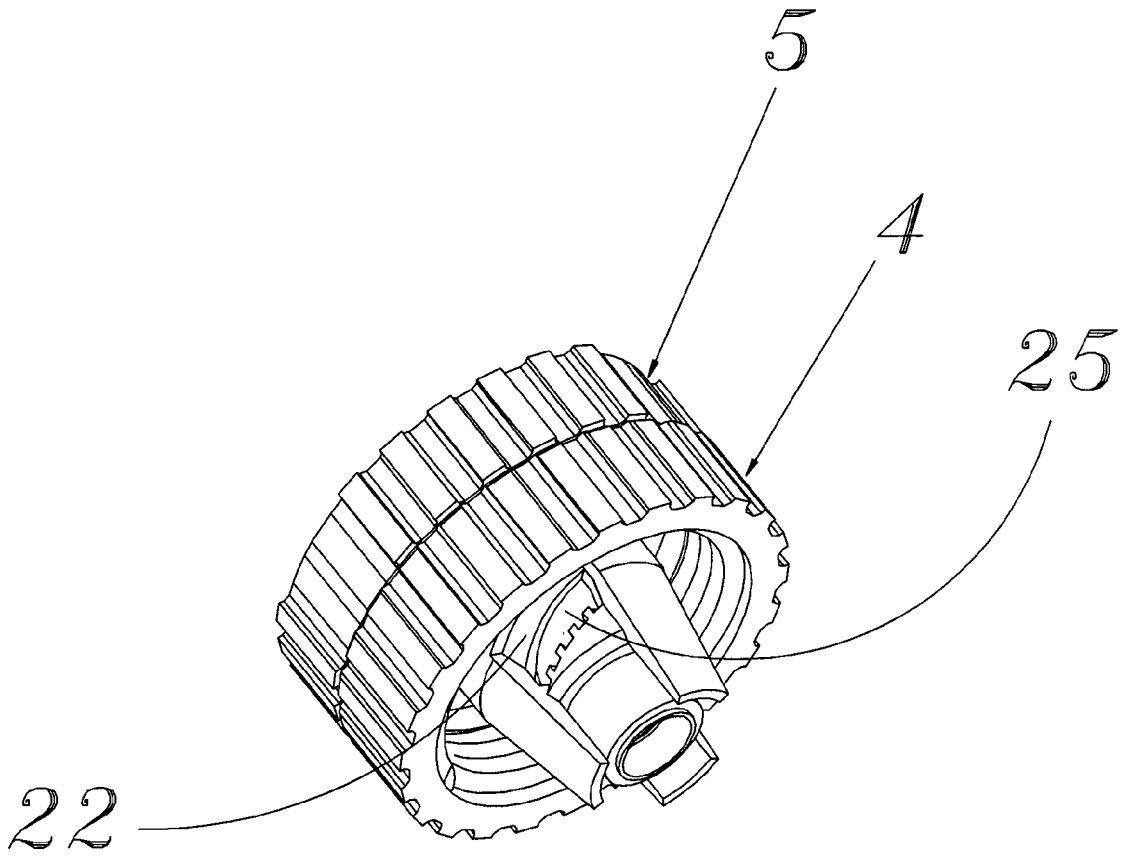

In the assembly 100, the range adjustment ring 5 has slots 20 as can be seen in FIG. 7, for example, that accommodate the posts 21 of the nozzle housing 4 shown in FIG. 6, for example. The ring 5 is insertable into the center hole 26 in the nozzle housing 4. The range adjustment ring 5 is connected to the ring 4 as illustrated in FIG. 8.

Figure 9:
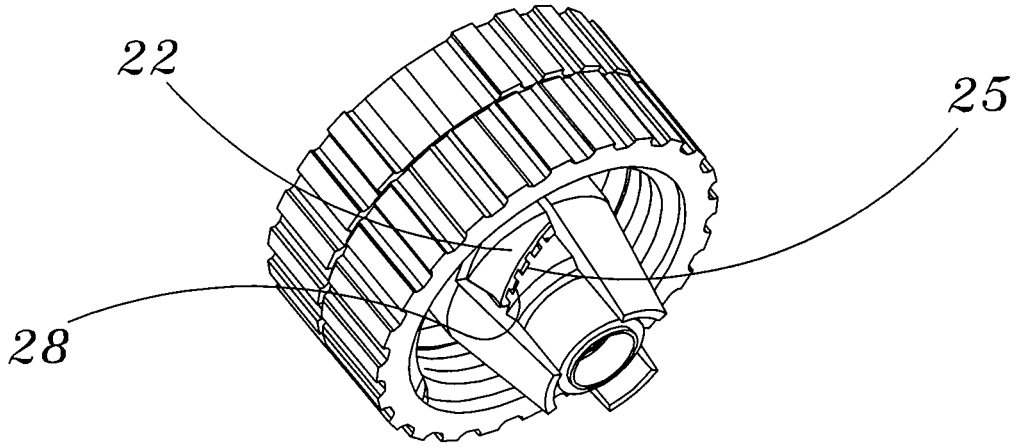
FIG. 9 is the same as FIG. 8 with the range flow set for minimum range

The range adjustment ring 5 is shown rotated relative to the nozzle housing so that the upstream flow opening is at a minimum in FIG. 9. That is, the radially stepped wall 22 of the ring 4 interacts with the radially stepped opening 25 of the ring 4. The teeth 28 along the bottom of opening 25 concentrate flow into minimum diameter streams that have a larger size than the openings in the filter 6 illustrated in FIG. 5, for example. In FIG. 8, the ring 5 is rotated relative to the ring 4 such that the opening 25 is maximized to increase flow.

Figure 10:
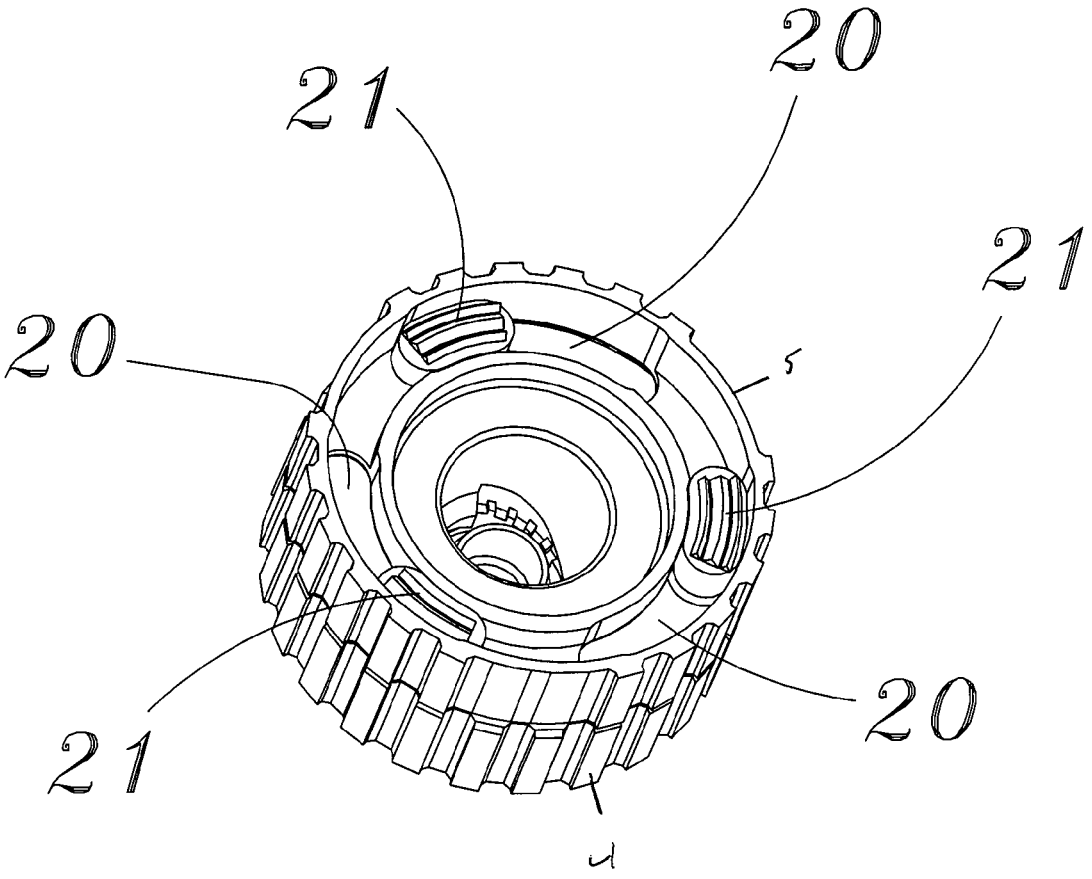
FIG. 10 is a top perspective view of the range setting ring mounted on the nozzle housing.
Figure 11:
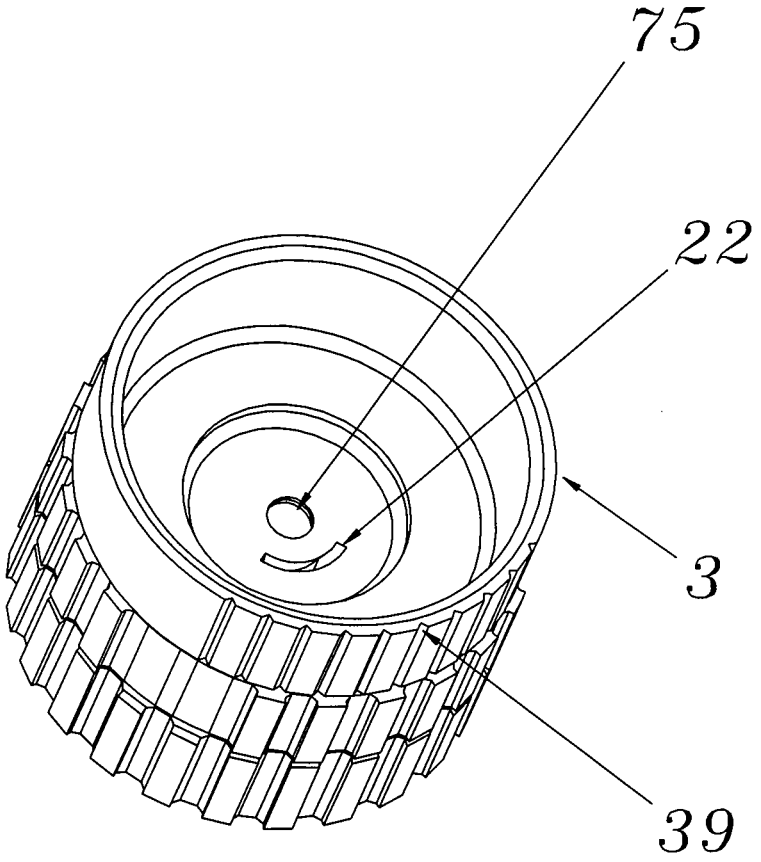
FIG. 11 is a top perspective view showing a fixed 90 degree arc of coverage setting member in the top of the range control setting ring on the nozzle housing

FIG. 10 is a top view of the ring 5 and the housing 4 with the protrusions 21 passing through the slots 20.

The posts 21 extending upward from the top of the nozzle housing 4 in FIG. 6 protrude through the openings 20 in the range adjustment ring 5 as can be seen in FIGS. 7 and 10. The posts 21 are preferably sonic welded to the arc ring 3 at 21A, for example such that the ring 3 is rotationally fixed to the housing 4. See FIG. 12. The center cylindrical shaft 40A may be snapped into the housing 4 at 40' as shown in FIG. 5 to secure the assembly together.

Figure 12:
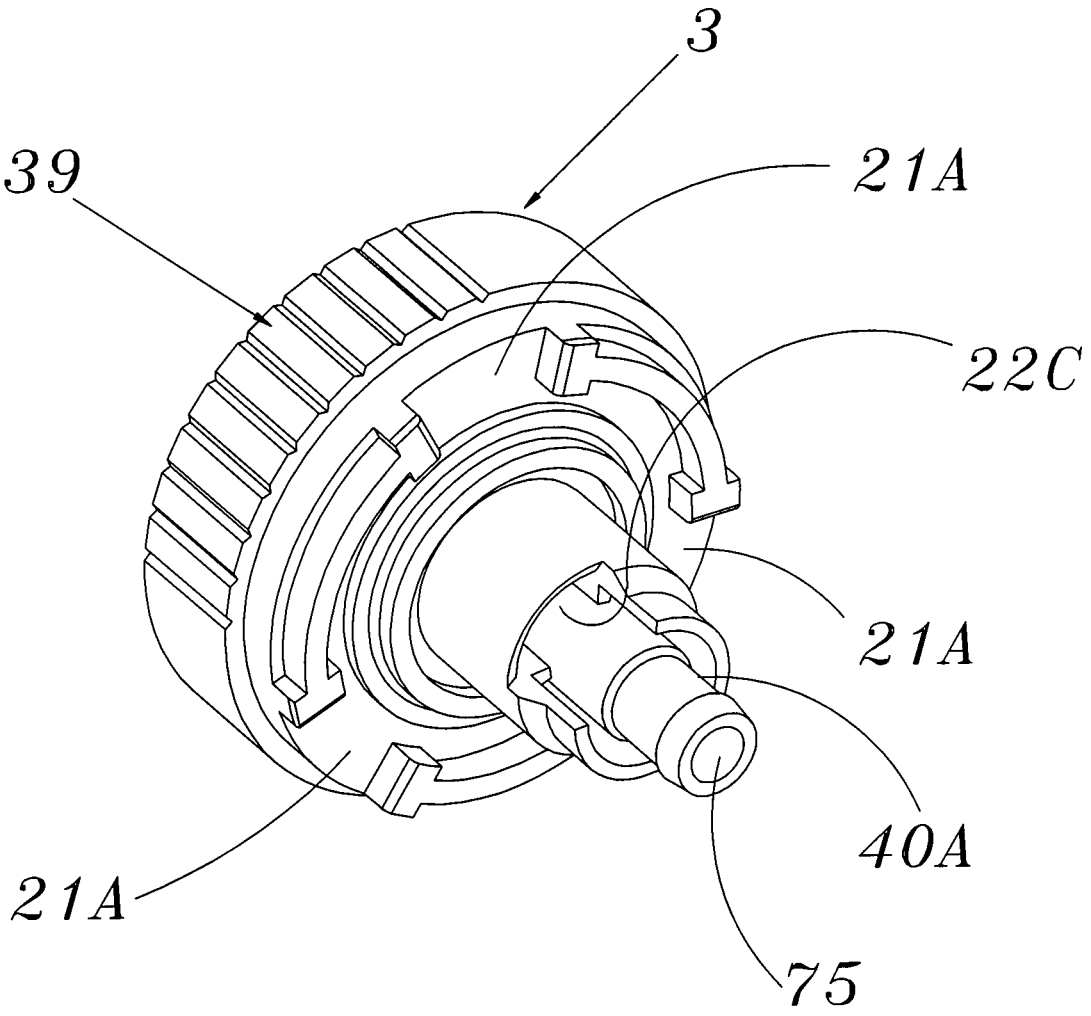
FIG. 12 is a bottom perspective view of the fixed 90 degree arc of coverage member.
Figure 13:
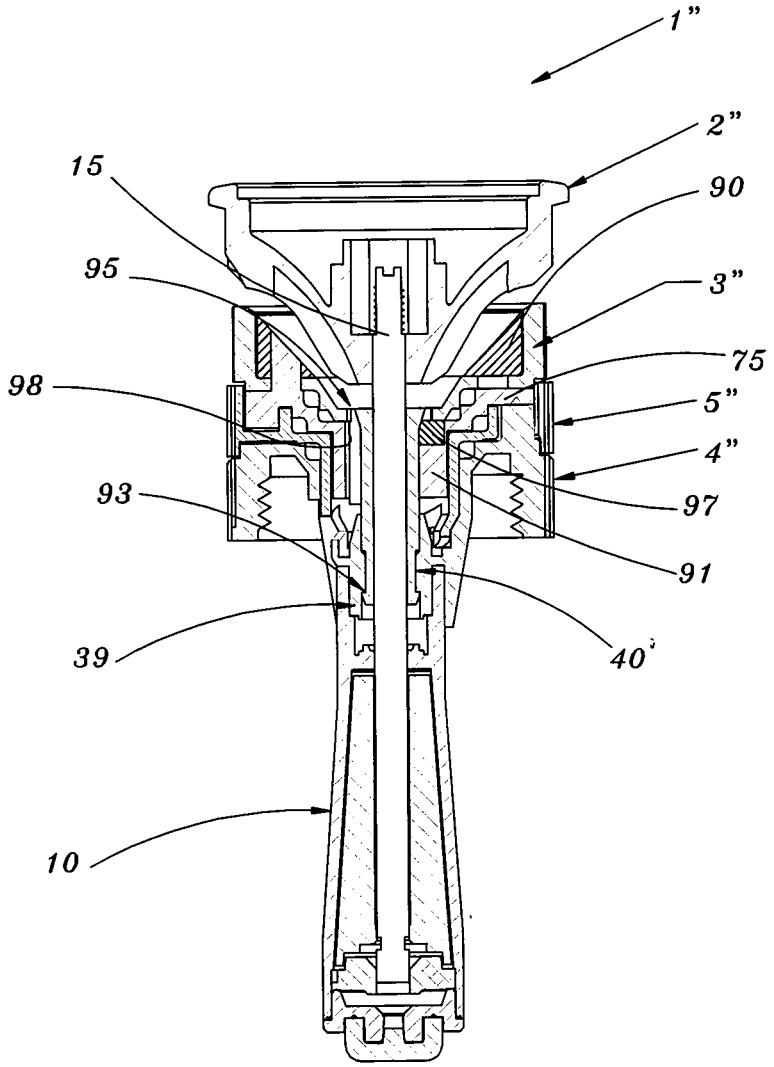
FIG. 13 is a cross section of another embodiment of a nozzle assembly of the present application with both the range of coverage and arc of coverage setting rings mounted on the nozzle housing and the viscous damping rotor assembly mounted on the bottom of the nozzle housing and the self driven rotary deflector mounted on the upstream side of the nozzle housing.
Figure 14:
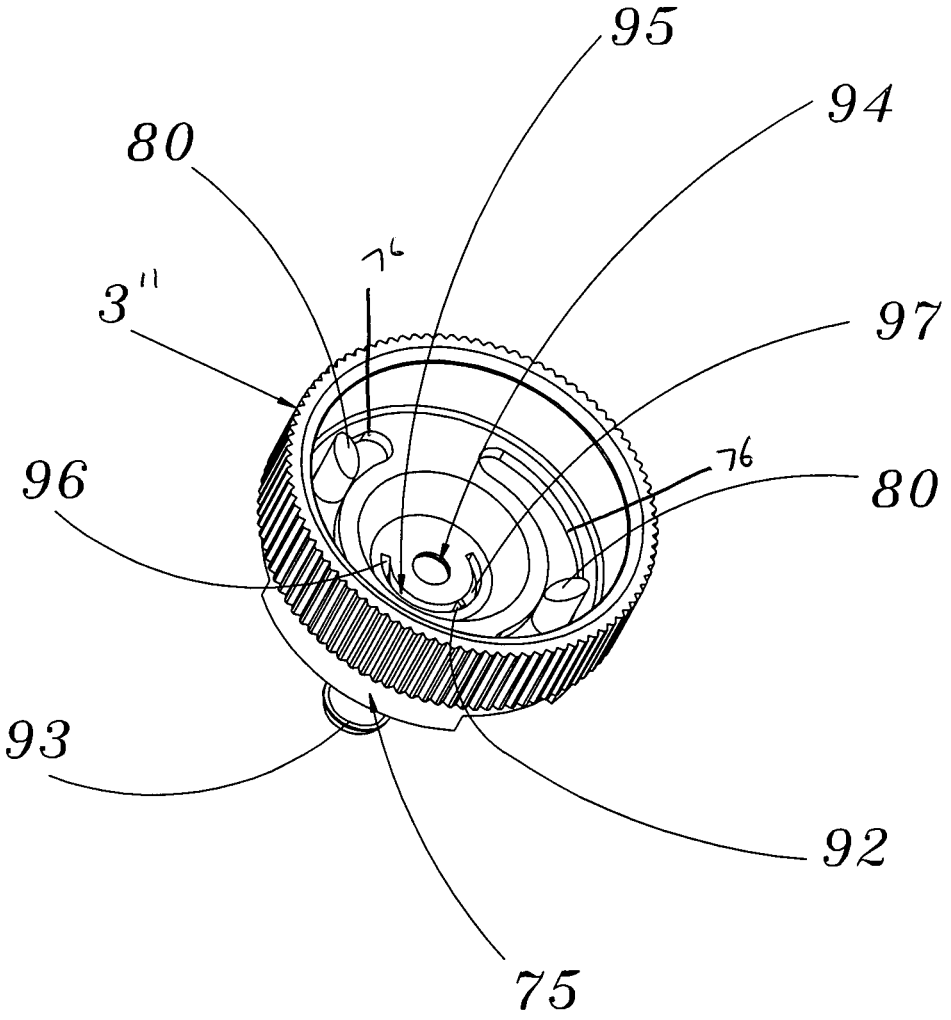
FIG. 14 is a top perspective view of the arc setting ring in its housing mounting member and with the range control ring and nozzle housing ring retention member removed.

FIG. 13 is a cross section of another embodiment of an adjustable nozzle assembly 1" in accordance with the present application. This embodiment is similar to that of FIG. 5 except that the arc set ring 3" is rotatable as shown in FIG. 14, by the slits 76 in the arc set ring 3". The posts 80 that protrude through the slits 76 in the ring 3" are used to hold the ring to the nozzle housing 4. The ring 3" (FIGS. 12 and 13) is used to provide the arc of coverage. The arc of coverage is set by the slot 95 and the indicated arc of coverage ribs around the outside of the ring.

The flow entering to the discharge, or exit, slot is shown as 22C in FIG. 12. FIG. 13 illustrates the adjustable nozzle configuration where the ring 3" is rotatable and supported on a supporting member 75 whose bottom is configured as shown for non-rotation in FIG. 14A and FIG. 15 with sonic welding surfaces 21A and posts 80 (FIG. 14) that protrude through the slits 76. The arc adjustment ring 3" may be retained by additional ring 90 (See FIG. 13, for example) which is attached to the post 80 or simply retained by the snap fit of lower shaft 93 at 40' in nozzle housing 4 as shown in FIG. 13.

In FIG. 14, the arc adjustment ring 3" is mounted on the supporting member 75 with the retention shafts protruding upward through the slits 76 in the ring 3". The arc adjustment ring 3" has a center shaft clearance hole 94 in its center and an arcuate adjustable length slot 95 formed therein.

Figure 14A:
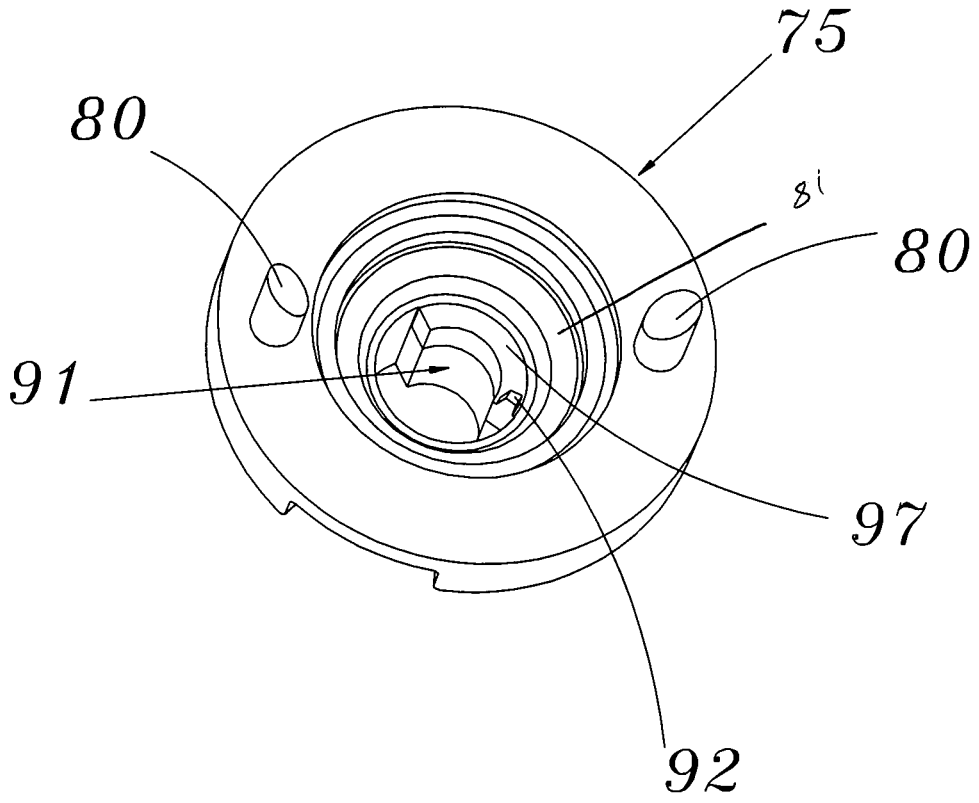
FIG. 14A is a top perspective view of the housing mounting member for mounting the arc adjustment ring of FIG. 14.
Figure 14B:
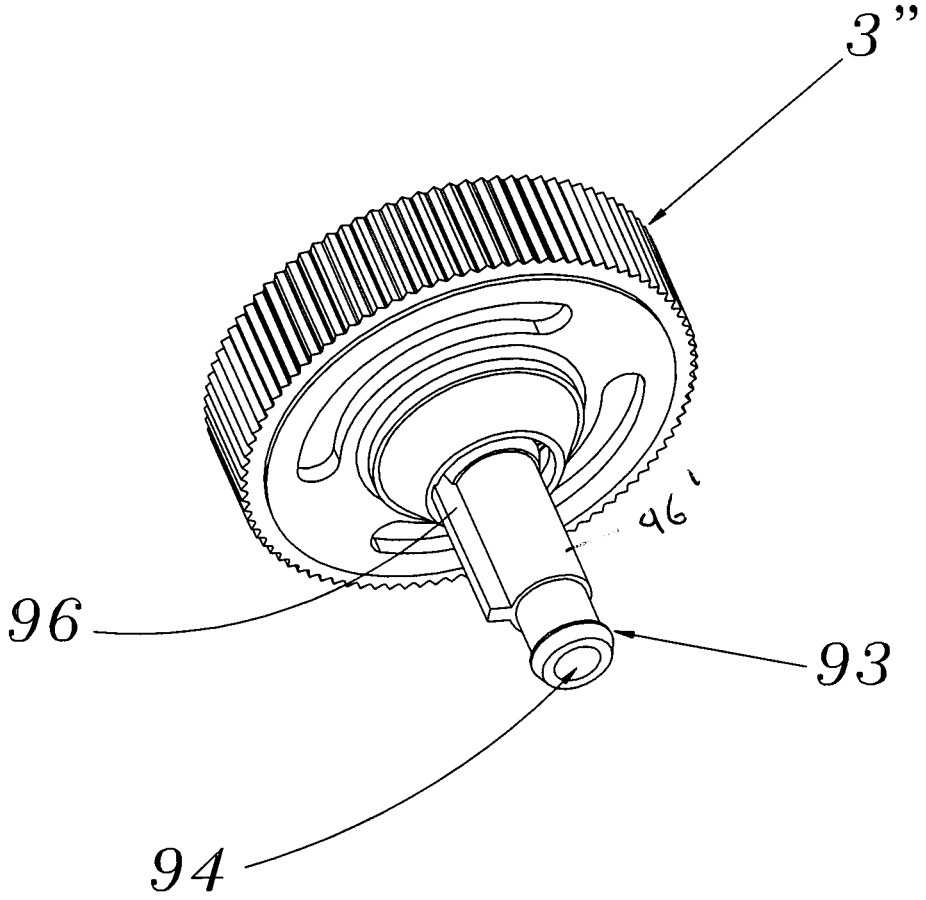
FIG. 14B is a bottom perspective view of the arc adjustment ring of FIG. 14.
Figure 15:
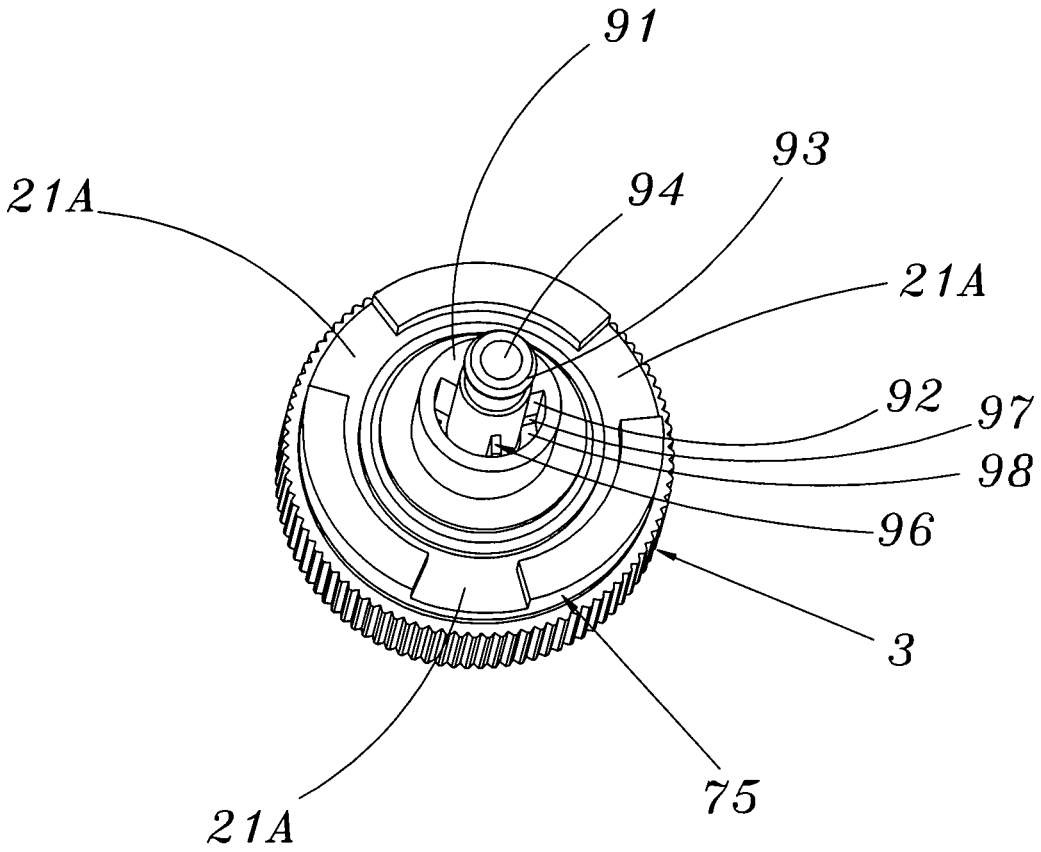
FIG. 15 is a bottom perspective view of the housing mounting member with the snap center shaft and the arc of coverage end closure rib shown protruding into the adjustable length arcuate slot.

In FIG. 15, the end closure rib 96 of the arcuate slot 95 can be seen in the arcuate opening 98 of the lower cylindrical area of the supporting member 75. In FIG. 14B the rib 96 protrudes downward on the center post 96'. The rib 96 is rotated around the post 96' in the open cylindrical area 81 as shown in FIG. 14A, for example.

The flow area to the slot 95 of FIG. 14 is adjustable in arcuate length as the arc adjustment ring 3" is rotated. The actual exit slot length is the portion of the arcuate slot open to discharge of water to the deflector. The length is set based on the space between the stationary closure surface 92 (see FIG. 14A) and the rib 96, as can be seen in FIG. 14.

In addition, a shut off portion is indicated at 97 of FIG. 14. Flow is prevented based on the presence of the solid portion 97 which is illustrated with a co-molded elastomeric sealing material on the sealing surface side of solid cylindrical portion 91 as shown in FIG. 15.

The stationary end closure 92 includes a standing rib shown at 92 in FIG. 14A that protrudes into the slot 95 as seen in FIG. 14. The closed off portion of the slot 95 is indicated at 97 in FIG. 14.

Figure 16:
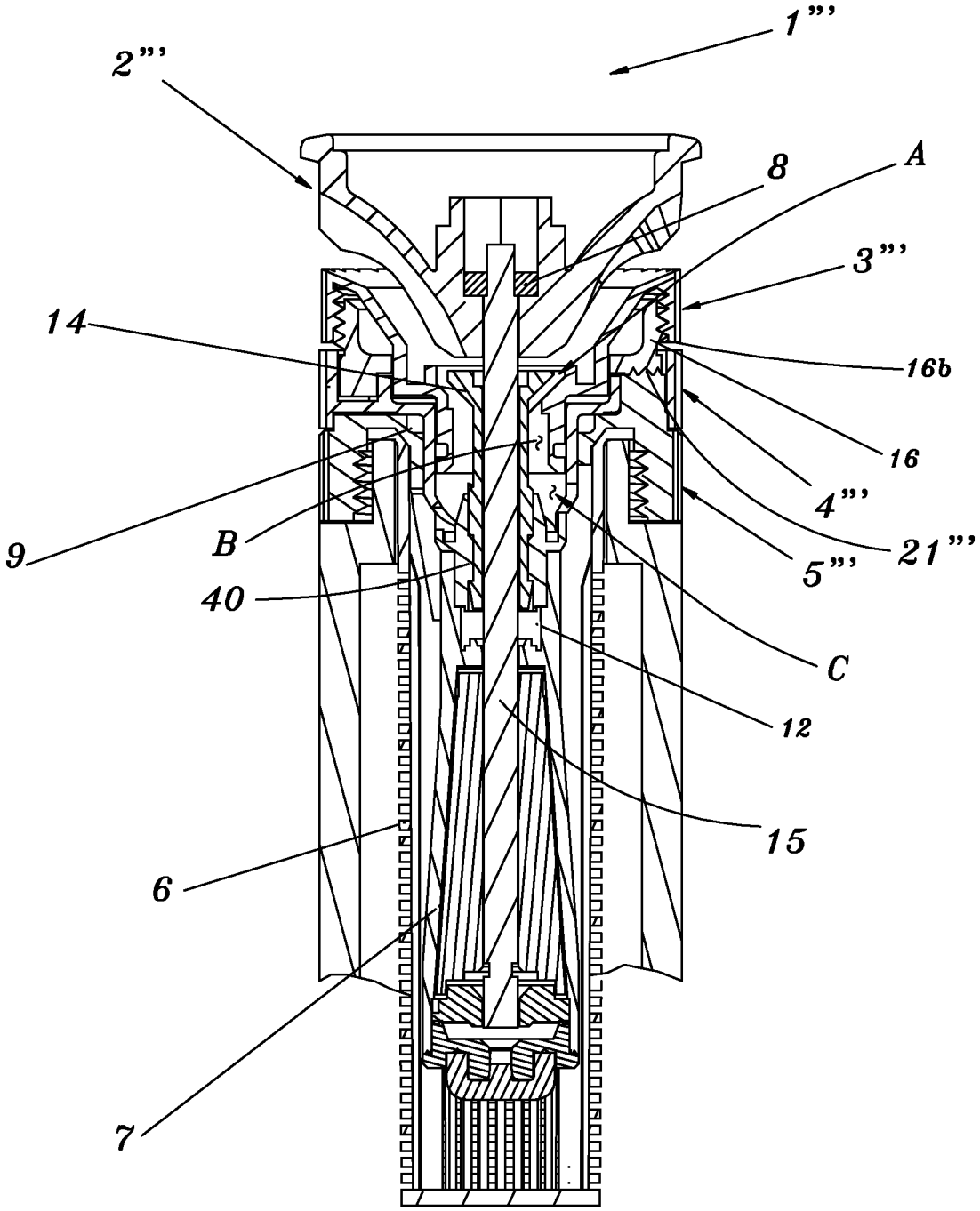
FIG. 16 shows a cross section of the nozzle assembly with full arc of coverage adjustment provided by interacting axially stepped spirals to provide an arcuate outlet opening

FIG. 16 illustrates a fully adjustable nozzle assembly 1'" in accordance with an embodiment of the present application. An arc adjustment ring 3'" and range adjustment ring 4'" are provided. The arc adjustment ring 3'" is connected to a housing mounting ring 16 by threads 16*b* with the same pitch as the axial step of the valving spirals 15*a* (See FIG. 18). Housing mounting ring 16*b* is preferably sonic welded to the support posts 21'" of nozzle housing 5'" as previously shown in FIG. 16. The flow of water in FIG. 16 goes from the upstream flow control area C into plenum area B and then through the arcuate opening at A.

Figure 17:
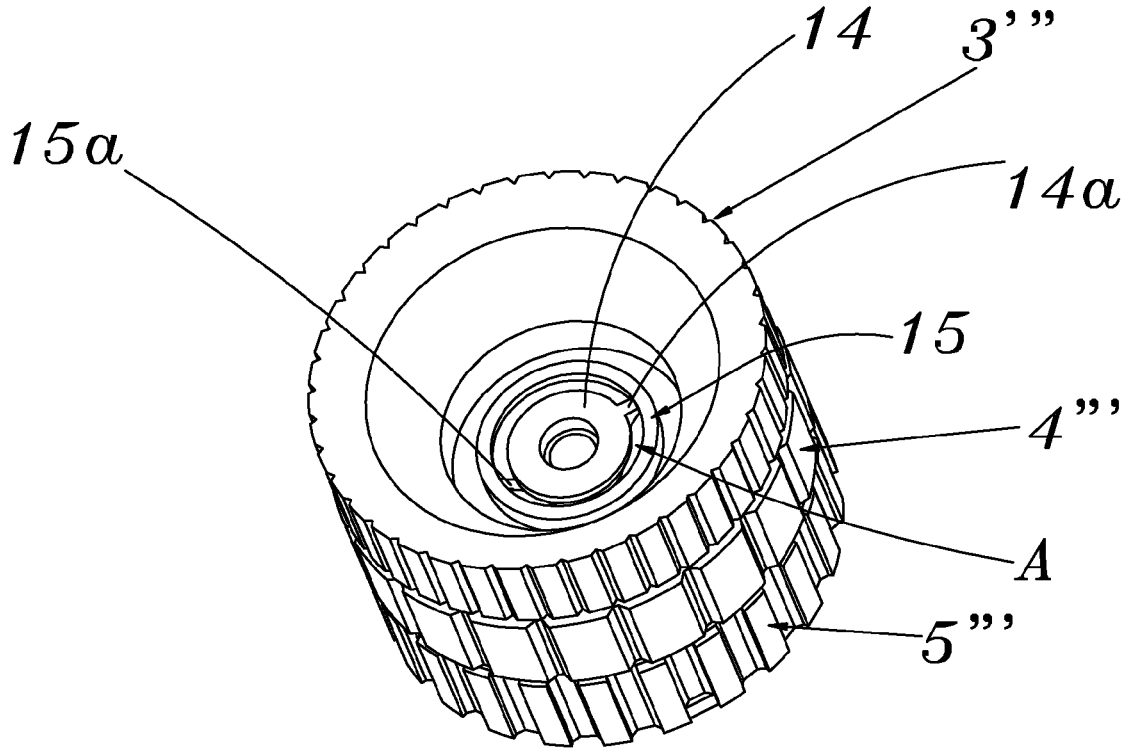
FIG. 17 shows a top perspective view of the arc of coverage setting ring with the rotating deflector removed and the viscous damping assembly and shaft removed.
Figure 18:
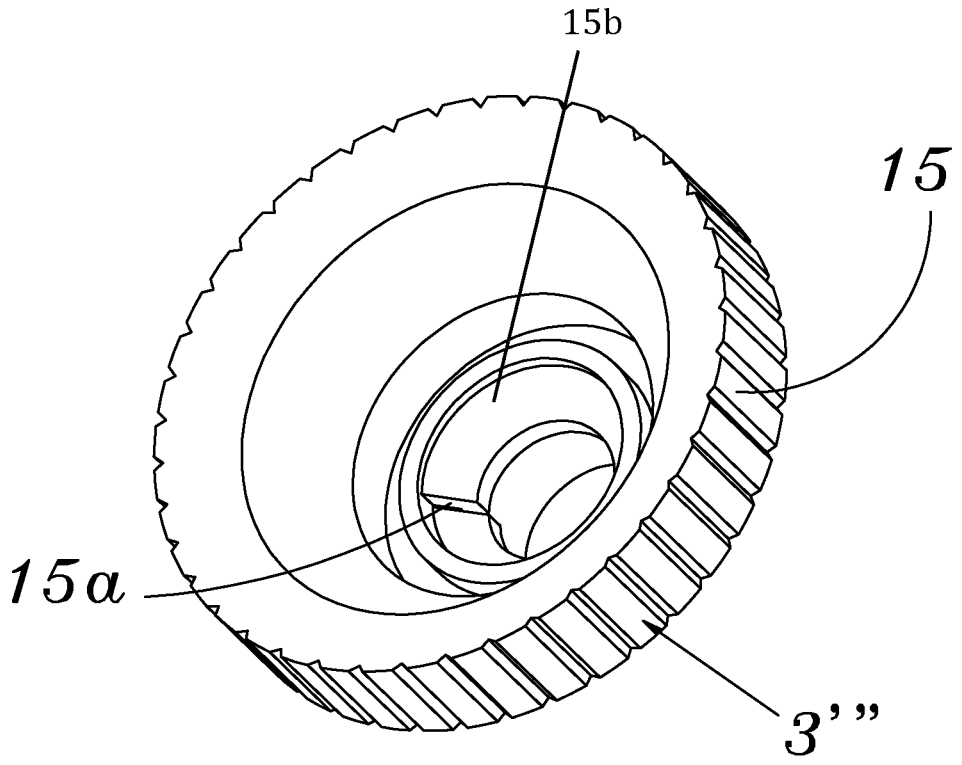
FIG. 18 shows a top perspective view of the arc of coverage setting ring with the deflector, or deflector, removed and the viscous damping assembly and shaft removed from the assembly with the lower half of the axially stepped spiral orifice valve showing.
Figure 19:
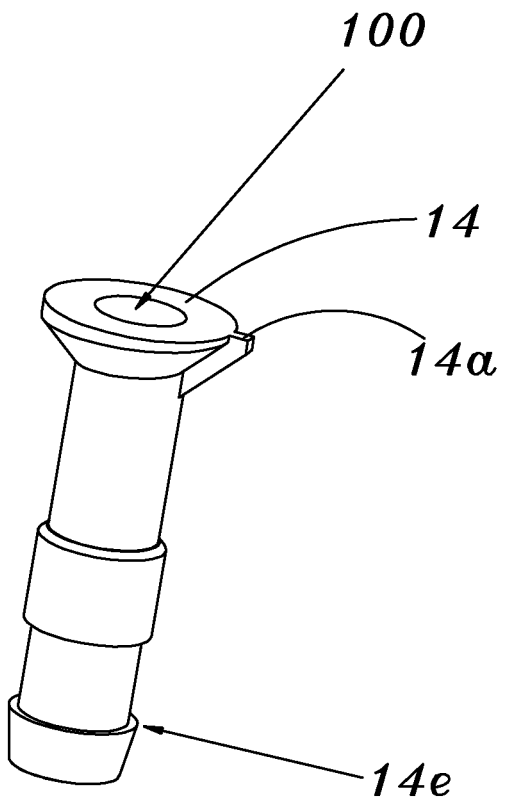
FIG. 19 is a perspective view of the upper half of the stepped spiral adjustable arcuate length orifice valve.

FIG. 17 illustrates a top view of the arc adjustment ring 3''' of FIG. 16 with the deflector 2 and center mounting shaft 15 removed. The upper spiral axially stepped valving insert has a rib 14*a* which fully defines the fixed end closure of a stepped upper valve element. The upper valving member insert 14 interacts with the arc adjustment ring 3''', and specifically, with a rib 15*a* thereof that defines an end of an axially stepped lower valve element. Adjustment of the ring 3''' relative to the insert 14 defines the arcuate length of the opening through which water flows, which sets the arc of coverage of the assembly 100'. The insert 14 is illustrated in isolation in FIG. 19. The insert 14 is rotationally keyed to the nozzle housing at 40. The rib 14*a* rides the extension of the valving surface 15*b* as shown in FIG. 18. As the ring 3''' is rotated relative to the insert 14, the opening between the axially stepped upper valve element of the insert 14 and the axially stepped lower valve element of the adjustment ring 15 shown in FIG. 18, for example, is modified to change the arc of coverage of the assembly 100'.

Figure 20:
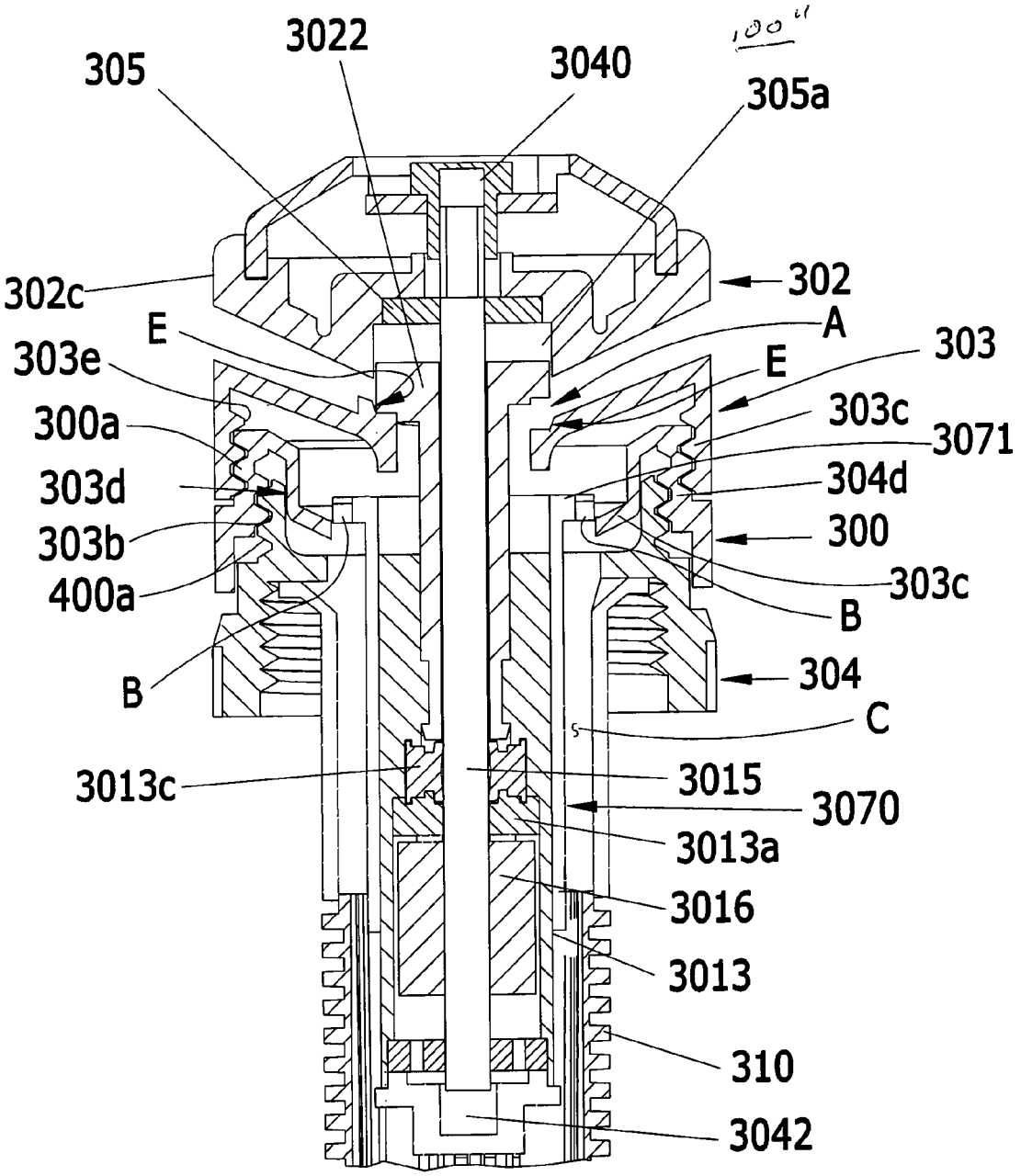
FIG. 20 is a cross section of a nozzle assembly with an arc of coverage adjustment ring and a range of coverage adjustment ring in accordance with an embodiment of the present application.

FIG. 20 illustrates a cross section of a fully adjustable arc of coverage rotating deflector sprinkler head nozzle assembly 1" in accordance with another embodiment of the present application. In this embodiment, the arc set adjustment ring 303, is preferably moved axially. This is accomplished via a thread 303*e* formed on the inside diameter of arc adjustment ring 303 whose pitch is the same as a radially stepped arc adjustment spiral 3022 to maintain arc set valving surface contact to allow for opening of the arc set ring 303 whose right hand side is shown open at A and whose left hand side is closed. That is, the size of the opening A is adjusted as the ring 303 rotates to change the arc of coverage of the assembly 100'.

Further, the upstream flow area B is adjusted to control flow, and thus, the range of coverage. The size of the opening B is increased and decreased to vary the flow proportionally to the arc of coverage set by the opening A to maintain a constant range once the axial relationship between upstream valving element 303*c* of the flow adjustment ring 300 and the flow insert 3070 is set. The insert 3070 is illustrated in more detail in FIG. 21, for example. The valving element 3071 of insert 3070 has been set for a desired range of coverage regardless of the arc of coverage setting after this relationship is established. The axial relationship between the valving element 3071 and the valving element 303C of the range adjustment ring 300 can be changed by differentially rotating the range adjustment ring 300 and holding the arc adjustment ring 303 stationary due to the action of the thread 303*e* on the inner diameter of the arc adjustment ring 303 and the threads 300*a* on the outside of the upper part of the range adjustment ring 300 whose diameter is reduced to thread inside of the arc adjustment ring 303.

Specifically, the pitch of threads 303*e*, 300*a*, 400*a* and 300*b* are all the same, so that as the arc adjustment ring 303 is held rotationally fixed and the range adjustment ring 300 is rotated to change the upstream flow area B, the range adjustment ring is unscrewed from thread 303*e* and is moved for a greater range of coverage; i.e. the flow area B would be further opened, then the threads 300*b* of the range control ring 300 are screwed down into the housing 400 with threads 400*a* maintaining the same total stack height to keep the spiral adjustable set valving surface of 3022 in contact as shown on the left and open at A as shown on the right and maintain the arc of coverage.

Figure 21:
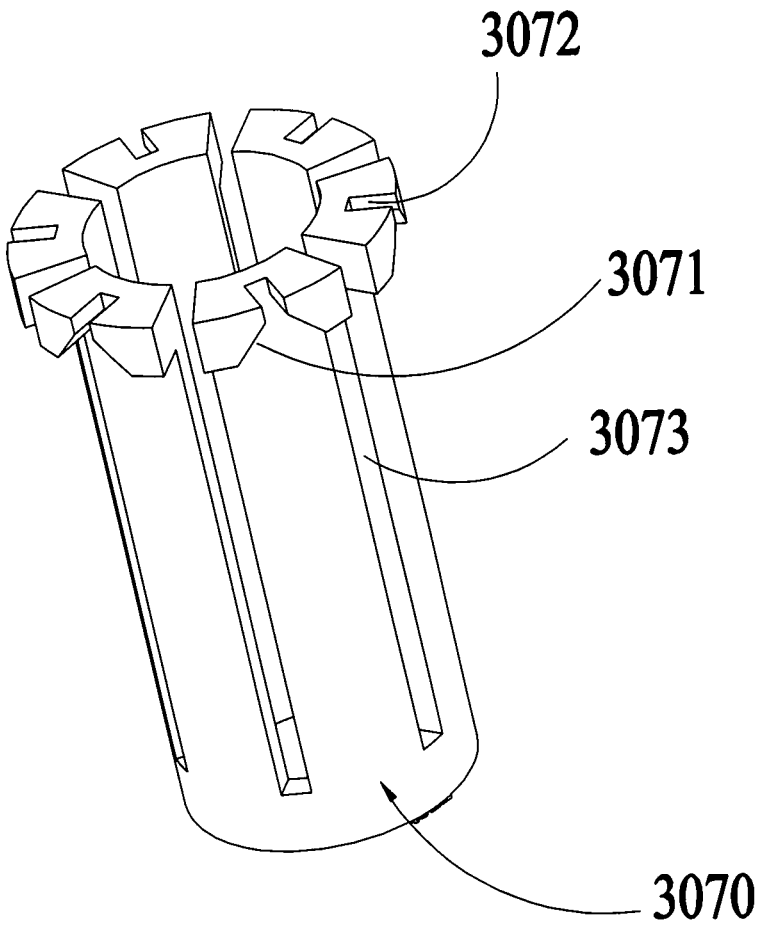
FIG. 21 is a range of coverage insert for the nozzle assembly of FIG. 20 to establish a new range of coverage and flow rate for the nozzle assembly in accordance with an embodiment of the present application.

FIG. 21 is an illustration of the upstream flow adjustment insert 3070 removed from the nozzle assembly 4 to show the detail of upstream valving element 3071 and minimum opening 3072 therein.

Figure 22:
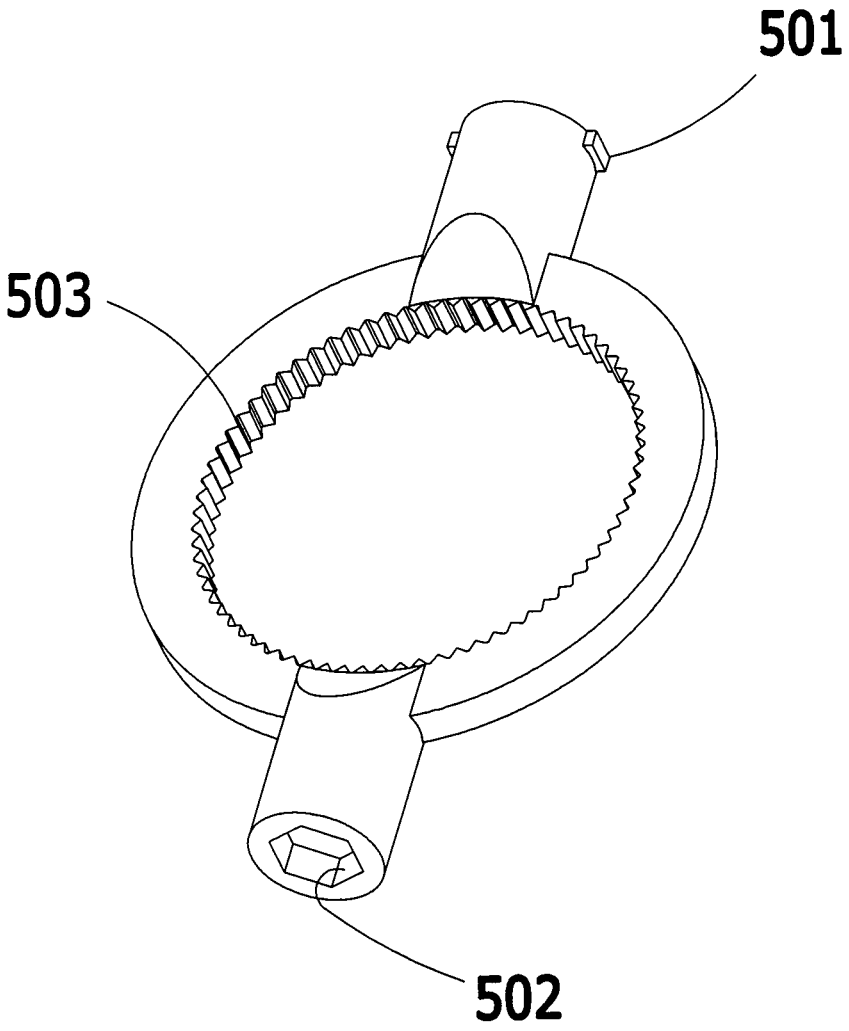
FIG. 22 illustrates a nozzle assembly tool with a ring for holding or separately turning the range control ring in accordance with an embodiment of the present application.

FIG. 22 shows a nozzle adjustment tool 500 with a hold ring opening 503 for holding or turning the narrow range adjustment ring 300, for example, while the arc adjustment ring 303 is turned, or held, to establish a different range of coverage for the nozzle assembly 100.

One additional feature of the assembly 1" of FIG. 20 is the deflection step E formed on the spiral valving surface 3022 which may be used to deflect the stream of water onto the deflector 302.

The deflector 302 is preferably made of an elastomeric material where the outer circumference can be deflected downward by tightening the nut 3040 in the center of the deflector shaft 3015 to modify the outer circumference 302*c* to deflect down, and thus, reduce the stream exit angle which can also be used to change the range of coverage of the assembly.

One of the benefits provided aside from rotor speed compensation for arc of coverage and range throttle pressure reduction to the nozzle discharge onto the rotating self driven deflector is that when a hex shaped nut is rotationally tied to the inside of opening 2*a* of the rotating deflector 2, its matching hex hole 21 shape and the nut tightens onto step 15*a* of the rotationally viscous damped shaft 15.

The rotating deflector shaft 15 extends down through the clearance holes in the center of arc quadrant 20 and its lower snap shaft and into a separate viscous damped rotor housing assembly 10 that is inserted in the nozzle house 4 at 41 . After it has been separately assembled, it is secured in place by a sonic weld and press fit at 41 to the cylindrical member 29 (see FIGS. 21 and 6, for example).

FIG. 24 also includes a different arc adjustment element where the arcuate length opening flow is controlled by closing off multiple small openings 121 around the circumference of a rubber insert 130 using the closure cylindrical area 3A'''' which can be rotated relative to the rubber insert 130. The arcuate exit slot 120 is shown being fed with water flow from multiple small holes as at 121 on the left hand side of FIG. 24 and shut off as shown on the right hand side by cylindrical lug 3A''''.

A perspective view of the assembly in FIG. 24 is illustrated in FIG. 25.

The sprinkler nozzle assembly of the present application thus provides for arc of coverage and range of coverage adjustment from the exterior of the assembly. This is provided by interaction between both radially stepped openings and axially stepped openings that are modified to increase and decrease the arcuate length of both outlet openings which controls arc of coverage and and upstream flow areas which controls range of coverage. Viscous damping may be provided in the nozzle housing or in the deflector itself. In addition, the nozzle assemblies of the present application may be used in conjunction with water turbines in place of viscous damping assemblies.

In a preferred embodiment, the range adjustment element is operably connected to the arc adjustment element such that a desired range of coverage is maintained as the arc of coverage is changed. Specifically, an upstream flow area is increased and decreased as appropriate to provide a substantially constant range of coverage despite changes in the arc of coverage.

Thus, for any particular arc of coverage, once the range of coverage is set, it will be maintained even as the arc of coverage is adjusted. The range control element preferably provides upstream proportional throttling of the flow area to adjust the range as the arc of coverage is adjusted.

Limited arc of coverage control is provided over an arc range of approximately 85 degrees to 185 degrees when radially stepped openings alone are used. In this case the adjustment components, such as the ring 3 and 5, for example, are snap fit together and to the housing 4, for example, to provide for easy manufacturing and assembly. When axially stepped openings are used, a full arc of coverage from 0 to 360 degrees may be provided.

In one embodiment flow control may be provided by inhibiting flow through a plurality of small openings as indicated in FIGS. 24-25, for example.

Although the present invention has been described in relation to particular embodiments thereof, many other variations and modifications and other uses will become apparent to those skilled in the art.

What is claimed is:

1. A sprinkler head nozzle assembly comprising:

a nozzle housing including an inlet for pressurized water and an outlet downstream of the inlet;

a rotating arc adjustment ring mounted on the housing such that rotation of the arc adjustment ring extends and reduces an arcuate nozzle discharge opening to set an arc of coverage of the sprinkler head nozzle assembly;

a rotating range adjustment ring mounted on the housing upstream of the arc adjustment ring such that rotation of the range adjustment ring increases and decreases flow of water to the arcuate nozzle discharge opening;

a rotating deflector, mounted on a central shaft extending through the arc adjustment ring, the range adjustment ring and the nozzle housing operable to distribute a flow of water extending through an upstream flow control area and the arcuate nozzle discharge opening outwardly from the nozzle assembly;

an upper valve element including an upper conical stepped spiral surface having a predetermined pitch where the stepped surface forms a fixed edge of the arcuate nozzle discharge opening; and a lower valve element positioned under the upper valve element and rotatable with the rotating range adjustment ring, such that rotation of the lower valve element changes the length of the arcuate nozzle discharge opening, the lower valve element including a lower stepped spiral surface with the predetermined pitch where the lower stepped spiral surface forms an adjustable edge of the arcuate nozzle discharge opening such that rotation of the lower valve element adjusts the length of the arcuate nozzle discharge opening to provide an adjustable cone shaped discharge flow of water onto the rotating deflector.

2. The sprinkler head nozzle assembly of claim 1, wherein the upper valve element further comprises a central clearance hole through which the central shaft extends to allow the rotation and axial movement of the rotating deflector.

3. The sprinkler head nozzle assembly of claim 2, wherein the rotating deflector is fixed to the central shaft.

4. The sprinkler head nozzle assembly of claim 3, further comprising a viscous brake assembly mounted in the nozzle assembly housing and connected to the central shaft to limit rotation speed of the central shaft and the rotating deflector.

5. The sprinkler head nozzle assembly of claim 2, wherein the central shaft and rotating distributor are rotated by a water turbine assembly positioned upstream thereof.

6. The sprinkler head nozzle assembly of claim 1, wherein the rotating deflector rotates based on force applied to a lower surface thereof by the cone shaped discharge flow of water applied thereto from the arcuate nozzle discharge opening.

7. The sprinkler head nozzle assembly of claim 1, further comprising a viscous brake assembly mounted in the rotating deflector and connected to the central shaft to limit rotation speed of the rotating deflector.

8. The sprinkler head nozzle assembly of claim 7, wherein the viscous brake further comprises an adjustment shaft to adjust speed of rotation based on the set arc of coverage and set range of coverage.

9. The sprinkler head assembly of claim 1, wherein the set arc of coverage of the sprinkler head assembly is adjustable from 0 to 360 degrees.

10. The sprinkler head nozzle assembly of claim 1, wherein the upper valve element includes a central column that extends through the lower valve element to contact the nozzle housing such that the upper valve element is secured thereto.

11. The sprinkler head nozzle assembly of claim 1, wherein the lower valve element is operably connected with the rotating arc adjustment ring, the rotating arc adjustment ring including threads of the predetermined pitch that engage the nozzle housing such that rotation thereof adjusts the length of the arcuate nozzle discharge opening.

12. The sprinkler head nozzle assembly of claim 1, wherein the set arc of coverage and set range of coverage are visible from an exterior of the sprinkler nozzle assembly.

13. The sprinkler head nozzle assembly of claim 1, wherein the rotating deflector is removable from the sprinkler nozzle assembly.

14. The sprinkler head nozzle assembly of claim 1, wherein the arc adjustment ring and range adjustment ring are operatively connected such that change in arc of coverage is proportional to change in range of coverage flow rate to maintain a desired range of coverage.

15. The sprinkler head nozzle assembly of claim 1, wherein the central shaft is mounted in a lower housing and retractable via a biasing element.

* * * * *